US010100846B2

(12) United States Patent
Peery et al.

(10) Patent No.: US 10,100,846 B2
(45) Date of Patent: Oct. 16, 2018

(54) METHOD AND APPARATUS FOR INDEPENDENTLY VARYING AIRFLOW AND NOISE GENERATION OF A FAN

(75) Inventors: Timothy M. Peery, Dripping Springs, TX (US); David W. Furnace, Dripping Springs, TX (US); James M. Peden, Dripping Springs, TX (US)

(73) Assignee: Envision Strategy Group, Inc., Austin, TX (US)

( * ) Notice: Subject to any disclaimer, the term of this patent is extended or adjusted under 35 U.S.C. 154(b) by 0 days.

(21) Appl. No.: 14/009,318

(22) PCT Filed: Apr. 2, 2012

(86) PCT No.: PCT/US2012/031865
§ 371 (c)(1),
(2), (4) Date: Oct. 28, 2013

(87) PCT Pub. No.: WO2012/135835
PCT Pub. Date: Oct. 4, 2012

(65) Prior Publication Data

US 2014/0086729 A1 Mar. 27, 2014

Related U.S. Application Data

(60) Provisional application No. 61/470,484, filed on Apr. 1, 2011.

(51) Int. Cl.
*F04D 29/66* (2006.01)
*F04D 29/38* (2006.01)
(Continued)

(52) U.S. Cl.
CPC ..... *F04D 29/666* (2013.01); *F04D 19/002* (2013.01); *F04D 27/002* (2013.01);
(Continued)

(58) Field of Classification Search
CPC .... F04D 27/002; F04D 29/384; F04D 29/052; F04D 29/666; F04D 29/665; F04D 19/002
(Continued)

(56) References Cited

U.S. PATENT DOCUMENTS 3,747,343 A * 7/1973 Rosen ..... 60/226.1
3,867,062 A * 2/1975 Troller ..... 415/194
(Continued)

FOREIGN PATENT DOCUMENTS

EP 1156224 A2 11/2011
KR 100218288 B1 6/1999

OTHER PUBLICATIONS

International Search Report from PCT/US212/031865 dated Nov. 21, 2012, 1 pg.

*Primary Examiner* — Woody Lee, Jr.
*Assistant Examiner* — Jesse Prager
(74) *Attorney, Agent, or Firm* — David D. Griner; Randall W. Burton

(57) ABSTRACT

A fan design method and fan structure is described, enabling independent control of the volume of airflow and the amount of noise produced. The noise produced is a close approximation to a pleasing red noise spectrum, and is generated solely by the interaction of the rotating fan blades with a petal assembly or a fan enclosure in several embodiments. A petal assembly may be positioned at varying spacings behind the rotating fan blades to control the level of noise production with minimal effect on the volume of airflow. Various aspects of the fan blade configuration, such as the blade pitch, camber, span, chord, etc., may be manipulated to control the ratio of airflow volume to the amount of noise produced.

11 Claims, 31 Drawing Sheets

(51) Int. Cl.
*F04D 27/00* (2006.01)
*F04D 19/00* (2006.01)
*F04D 29/052* (2006.01)

(52) U.S. Cl.
CPC ..... *F04D 29/052* (2013.01); *F04D 29/384* (2013.01); *F04D 29/665* (2013.01)

(58) Field of Classification Search
USPC ..... 415/119, 140, 143, 149.2; 416/5, 131, 416/133, 140, 175, 193 R, 203, 205, 500
See application file for complete search history.

(56) References Cited

U.S. PATENT DOCUMENTS 3,883,264 A * 5/1975 Rao ..... 415/119
4,514,140 A * 4/1985 Knopf ..... 415/119
4,640,668 A * 2/1987 Yang ..... 417/354
4,883,240 A * 11/1989 Adamson et al. ..... 244/69
5,692,702 A * 12/1997 Andersson ..... F04D 29/663 181/206
5,724,826 A 3/1998 Han
6,146,097 A * 11/2000 Bradt ..... 416/5
6,655,918 B2 12/2003 Otsuka
8,449,252 B2 * 5/2013 Van Otten Tolman ..... 416/1
8,661,781 B2 * 3/2014 Moore ..... B64C 11/48 244/17.23
2004/0067138 A1 4/2004 Yoshida
2006/0280596 A1 12/2006 Kim et al.
2007/0134093 A1 * 6/2007 Weiler ..... 416/60
2007/0212227 A1 * 9/2007 Koehler ..... 416/246
2010/0206982 A1 8/2010 Moore et al.
2010/0316495 A1 * 12/2010 Todd, Jr. ..... 416/5
2011/0020135 A1 1/2011 Itou et al.
2011/0064559 A1 3/2011 Gerard et al.

* cited by examiner

METHOD AND APPARATUS FOR INDEPENDENTLY VARYING AIRFLOW AND NOISE GENERATION OF A FAN

CROSS-REFERENCE TO RELATED APPLICATION

The present application claims priority from PCT Application No. PCT/US 12/31865, filed Apr. 2, 2012, entitled "METHOD AND APPARATUS FOR INDEPENDENTLY VARYING AIRFLOW AND NOISE GENERATION OF A FAN" naming inventors Timothy M. Perry, David W. Furnace and James M. Peden, which in turn claims priority to U.S. Provisional Patent Application Ser. No. 61/470,484 filed Apr. 1, 2011, entitled "METHOD AND APPARATUS FOR INDEPENDENTLY VARYING AIRFLOW AND NOISE GENERATION OF A FAN" naming inventors Timothy M. Perry et al., which are all incorporated by reference herein in their entirety.

TECHNICAL FIELD OF THE INVENTION

The present invention relates to fans and in particular to a method and structure for independently varying the volume of airflow and the noise generation in a fan.

BACKGROUND OF THE INVENTION

White noise generators generate sound at frequencies across the spectrum and are used as sleep aids or to protect privacy by masking other sound, such as conversations. Some so-called "white noise generators" actually generate "red" or "pink noise," which sounds less harsh. In red noise, the power decreases as the frequency increases, so that more of the noise is generated at lower frequencies. Many white noise generators use electronic circuitry to generate a desired noise spectrum, which is output through a speaker. Although many people prefer background noise when sleeping, studying, working, etc., electronically generated noise often sounds artificial. Additionally, many people can detect patterns in the generated noise which make it less effective as pure background sound.

As a result, many people employ mechanical devices to produce background noise. Bedroom fans, for example, have long been used to generate noise to help people sleep. Fans are especially desirable because they provide not only noise, but also airflow, allowing more effective body temperature regulation by convection and more effective evaporation of perspiration. As the speed of the fan is increased to move more air, the noise level is increased. The sound of a fan is determined by the structure of the fan and its speed. The sound is therefore fixed by the setting of the fan speed. This dependence of the noise on the amount of air movement is unfortunate, however, because it may be desirable to change the sound without changing the airflow, or to change the airflow without changing the sound.

SUMMARY OF THE INVENTION

An object of the invention to provide an improved fan design in which the volume of airflow produced may be controlled variably from the amount of noise produced.

Preferred embodiments of the present invention include a rotating fan blade assembly, and a coaxially-mounted petal assembly. In some preferred embodiments, a proximity device such as a petal assembly may be mounted off-axis but parallel to the axis of the blades or near-axial but not parallel to the axis. The relative spacing between the fan blades and petals and other geometrical factors may be adjusted either manually by the fan user, or based on inputs from an automatic fan controller, to vary the amount of noise production with minimal effect on the volume of airflow produced by the fan blades. Several embodiments are presented, principally characterized by the design of their respective petals. The interaction of the pressure wave produced by the rotating fan blades with the petals enables the purely aerodynamic (i.e., non-electronic, non-contact) generation of pleasing pseudo-red noise. Through control of the fan blade characteristics, such as blade angle, camber, chord, span, etc., the noise and volume of airflow may be varied differently over a wide range relative to the prior art. Through the combination of fan blade speed, fan characteristics, and the spacing to the petals assemblies, the several embodiments allow a wide range of airflow volumes and noise amounts and tones to be produced.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1:
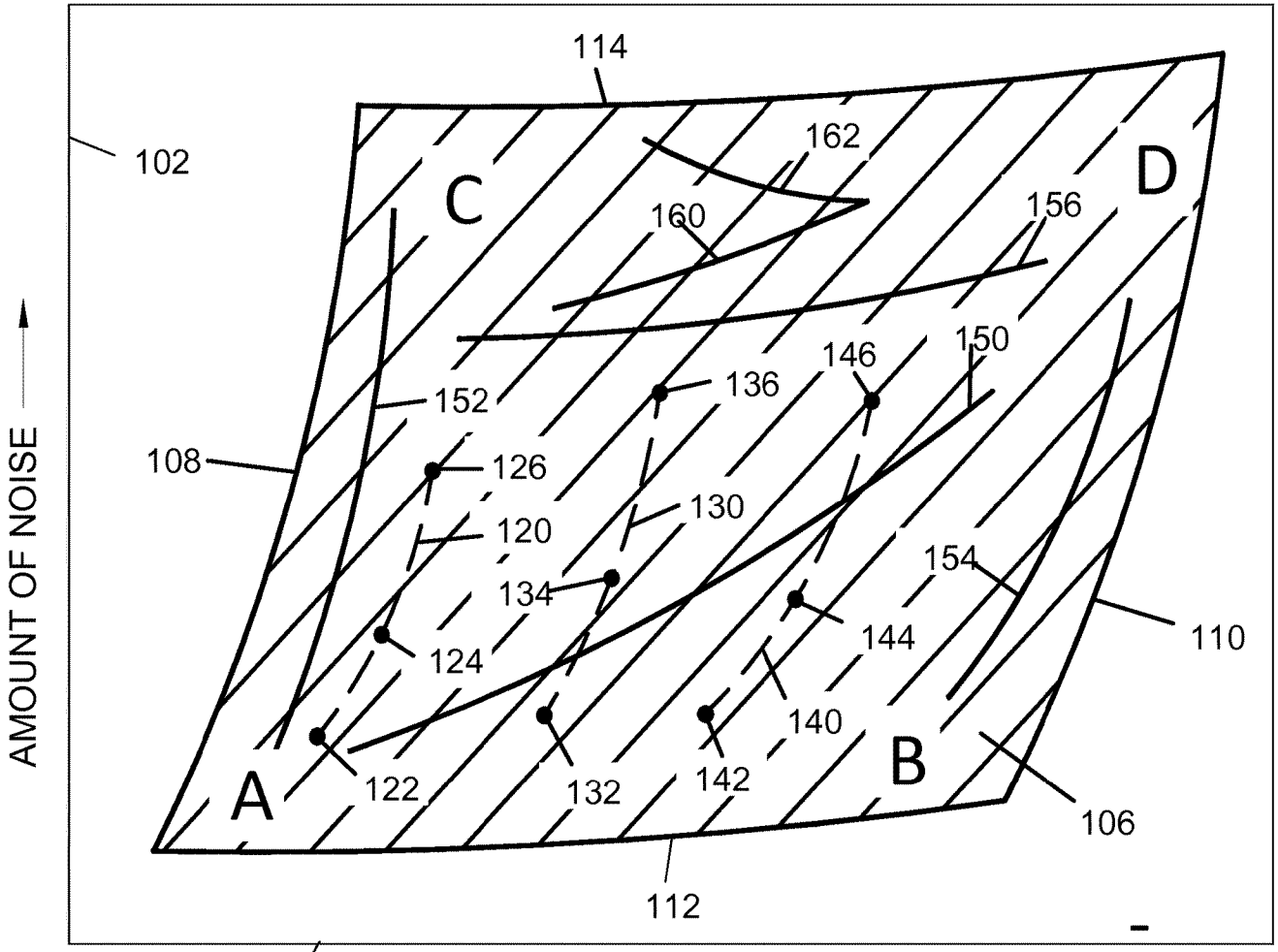
FIG. 1 is a schematic graph of the amount of noise produced by a fan plotted against the volume of air circulated by the fan for both the prior art and embodiments of the invention.

Preferred embodiments of the present invention are directed at an improved fan suitable for use as a "sleep fan" to produce a pleasing background sound as well as air movement that can be used to improve sleep quality for users. According to some preferred embodiments the volume and/or characteristics of sound produced while the fan is operated can be varied without substantially changing the airflow produced by the fan. Further, according to some embodiments the airflow can be varied while the sound volume and characteristics of the sound can be kept relatively constant. As used herein, the term "sound" will be used to refer to the transmission of vibrations of any frequency that can be detected by human hearing. When reference is made to the sound produced by the fan, the term will include all sound produced during operation of the fan, whether produced by the rotation of the blades, the interaction of the blades and a proximity device or element to produce a pressure wave, or the sound produced by the airflow itself. The terms "sound" and "noise" will be used interchangeably herein. Also, the terms volume, intensity, and amount may all be used interchangeably with respect to expressing the total sound intensity.

Person of skill in the art will recognize that for many of the embodiments described herein, changing a characteristic of the sound produced by the fan (such as the volume, frequency, modulation, timbre, harmonics, reverberation, etc.) may have some effect on the airflow, but the effect will be small compared to the normal relationship between airflow and volume in prior art fans. For example, the sound volume, or some other sound characteristic, can preferably be varied over the entire range of possible adjustments while the airflow varies by less than 10%, more preferably by less than 5%. The same is preferably true for adjusting the airflow while keeping the sound characteristic varying by less than 10%, more preferably by less than 5%. As used herein, this will be referred to as allowing one of either the airflow or sound characteristics to be varied independently from the other.

Preferred embodiments of the present invention also provide fan blades that can produce a wide range of airflow volume (by changing the speed of blade rotation) while producing minimal noise, even at higher speeds (and corresponding high airflow volume). On the other hand, other preferred embodiments of the present invention also provide fan blades that can produce a wide range of airflow volume (by changing the speed of blade rotation) while producing relatively high volumes of noise, even at lower speeds (and corresponding low airflow volume).

Also, preferred embodiments of the present invention also provide fans that when operated produce sound that has characteristics that are associated with a "pleasing sound" for use as background noise, especially for sleeping. Although obviously a pleasing sound will vary somewhat based on individual taste, in general sound in the red noise spectrum will be a pleasing background noise for most people. As discussed in greater detail below, it is not necessary that the fan sound correspond perfectly to a perfect red noise curve. Measured noise spectra that is similar to the perfect red noise curve (i.e., does not vary by more than 20 db at a given frequency) is sometimes referred to as "pseudo red noise" and has been found by Applicants to produce a noise that is as pleasing to most people as perfect red noise. As used herein, the term "red noise" will be used to refer to measured noise spectra that does not vary from the perfect red noise curve by more than 20 db at any given frequency. Persons of skill will recognize that the further away from the ideal red noise curve the measured noise spectra is, the less pleasant the noise will be to most listeners.

Embodiments of the invention can provide one or more advantages over typical prior art fans. Not all embodiments will provide all the benefits. A preferred method or apparatus of the present invention has many novel aspects, and because the invention can be embodied in different methods or apparatuses for different purposes, not every aspect need be present in every embodiment. Moreover, many of the aspects of the described embodiments may be separately patentable.

In the discussion below, various aspects involved with fan design according to preferred embodiments of the present invention will be described, including both the control of airflow and the control over the amount of noise produced during operation. Methods of producing a pleasing pseudo red noise when a fan is operated are also described. Finally, exemplary embodiments of the present invention are described below. These embodiments are merely exemplary, however, and do not define the scope of the invention with respect to either optimizing airflow through improved blade design, or the independent control of noise production and airflow.

FIG. 1 is a schematic graph 100 showing the amount of noise 102 produced by a fan plotted against the volume of air 104 circulated by the fan for both the prior art and embodiments of the invention. In the prior art, the goal of fan design methods has generally been to maximize the volume of airflow produced by a fan while simultaneously minimizing the amount of noise produced by the fan. Three representative schematic curves 120, 130, and 140 are shown for prior art fans. Curve 120 represents a fairly inefficient fan where the volume of airflow produced is relatively low compared with the amount of noise produced. Three fan speed settings, low 122, medium 124 and high 126 produce increasing amounts of airflow at the expense of increased noise production.

Schematic curve 130 represents a "better" fan, i.e., a fan for which the volume of airflow is higher for a given level of noise produced. Note that in the prior art, since in general noise is considered an unfortunate but unavoidable by-product of the desire for airflow, a "better" fan would demonstrate a higher ratio of airflow to noise production. As for curve 120, curve 130 has three points on it, representing low 132, medium 134, and high 136 settings for airflow, typical of fans not having proportional speed settings.

Finally, curve 140 represents a fan which in the prior art would be considered even better than the fans producing curves 120 and 130, since the ratio of airflow to noise produced for this third prior art fan is lower than for either of curves 120 or 130. Three speed settings low 142, medium 144, and high 146 again represent tradeoffs between higher airflow and increasing noise, however, with much higher average airflow for all three speeds.

Significantly, all three representative prior art fans lack the capability to independently control noise volume (or any other noise characteristic) relative to the volume of airflow. Shaded region 106 represents the operating range preferred of embodiments of the present invention, with four operating regimes labeled A-D which are described below. Region 106 has four boundaries, representing the minimum 108 and maximum 110 volumes of airflow, and the minimum 112 and maximum 114 amounts of noise production. Region 106 is shown schematically here for exemplary purposes only. The exact values and ratios of airflow volume and noise volume will depend on the particular embodiment of the invention. The four regions A-D represent the following performance goals, both in the prior art and for the invention:

A) Low Volume of Airflow and Low Amount of Noise. As in the prior art, this regime can be addressed with fairly inefficient fan blade designs running at low enough speeds to not make an excessive amount of noise.

B) High Volume of Airflow and Low Amount of Noise. This regime requires very efficient moving of air. Typical prior art fans are unable to operate in region B for one of the following reasons:

When operated at low speed, although the noise will not be excessive, the volume of airflow will be too low, i.e., the prior art will be to the left of region B, neighboring on region A.

When operated at higher speeds, although now the airflow is acceptable, the amount of noise will be much greater due to the inefficiency of the fan blades in converting rotational motion into linear motion of the air, i.e., at higher speeds prior art fans will operate closer to region C.

C) Low Volume of Airflow and High Amount of Noise. This regime is considered undesirable in the prior art, since the principal design goal of fans is to produce airflow with as little noise generation as possible. Due to the inefficiencies of prior art fan blade design, prior art fans typically will operate between regions A and tending towards region C, although usually not with enough airflow or noise production to completely reach region D.

D) High Volume of Airflow and High Amount of Noise. This regime requires generally higher fan speeds and intermediate efficiencies of airflow production, thus fan motor powers will be maximized in this region. Applicants have found that for a fan to be capable of spanning large portions of region 106 (comprising all of regions A-D) it is necessary to first design the fan blades to be able to efficiently move air (i.e., to be able to operate in regions A and B because efficient moving of air means that the fan motor can be operated at lower speeds which produces less noise).

To operate in regions C and D, prior art fans require higher fan speeds so that the fan motor and blades produce more noise. As described in greater detail below, however, fans according to preferred embodiments of the present invention can operate in regions C and D by supplementing the sound volume generated by the fan and blades. For example, many of the preferred embodiments described below make use of added "petal assemblies" behind (upstream from the fan blade so that the primary direction of airflow is away from the petal assemblies) the fan blades which act to increase the noise production well above (e.g., by as much as 25 dB) what would be produced due to just the motion of the fan blades themselves. An alternative approach for operating in regions C and D is to change the operating regime of the fan blades themselves, as is also discussed below.

Thus, for operation over large portions of region 106, we must first address operation region B, which is inherently the most difficult since it requires low noise but a high volume of airflow. It is intuitively obvious that it is much easier to make an efficient fan blade less efficient (in order to generate more noise) than it is to make an inefficient fan blade quieter. The design methodology of the present invention, was thus to first focus on designing the most efficient fan blades, while still including the capability of generating more noise, either by adding additional elements (such as petal assemblies) or by modifying the operating characteristics of the fan blades themselves. Both approaches fall within the scope of the present invention since these are all ways of enabling the fan user to select the volume of airflow independently of the amount of noise produced anywhere within region 106.

For example, curve 152 may represent variation of the distance of a petal assembly (as described below) relative to the fan blades where the fan blades are configured to produce relatively low airflow. Conversely, curve 154 may represent a similar variation of the distance of the petals assembly relative to the fan blades where the fan blades are configured to produce relatively high airflow, for example by increasing the pitch of the fan blades compared with the pitch used for curve 152. Other curves 150 and 156 represent other tradeoffs between volume of airflow and amount of noise produced—with a fan motor capable of variable speed control, any point along any of curves 152, 154, 150 or 156 may be selected by the fan user.

For preferred embodiments of the present invention, testing by Applicants has shown 5 dB lower noise production at a given airflow than any prior art fan tested, with 16% higher efficiency in transferring shaft power to airflow production.

Efficient Fan Blade Design Considerations

Operating in Region B

It is interesting to first consider the designs of prior art fan blades, which we have seen may be capable of generating large volumes of airflow (but at the expense of high noise production—and this may not be the pleasing pseudo red noise that fan users prefer) or lower amounts of noise (but at the expense of possibly inadequate airflow). As was touched on above, to operate in the most difficult region B, we need the most efficient production of airflow possible. This problem was first addressed and solved by the Wright brothers in 1902 when they realized that the propellers in use by other early aviators were not very efficient at converting the power of their engines into enough airflow to propel an aircraft off the ground. What they realized was that a propeller is essentially an airfoil rotating in a circle to generate lift along the axis of the propeller shaft.

Optimum fan blade design is essentially the same, except instead of propelling the fan across the room, we want to most efficiently convert the motor power into volumes of air moved (which does, however exert a thrust on the fan body which must be taken into account). There are a number of concepts/characteristics that are applicable to efficient fan blade design.

Fan Material—Fan blades may generally be made of a number of materials, such as wood, various types of plastic (both soft and hard), metal, composite materials, etc. Obviously one key consideration is tensile strength—fan blades are subjected to high centrifugal forces, tending to pull the blades apart radially. High strength is also important since fan blades may be subject to impact from foreign objects. If one blade were to break, the entire fan assembly would then be rotating severely out of balance, possibly resulting in the entire fan assembly shaking itself off of its support location, or even flying apart completely. This consideration has another, opposite aspect, however. If the "foreign object" interfering with the rotating fan blades is a hand or animal, for example, some form of slip clutch in the drive train from the motor to the blades may be beneficial, so that the blade motion may be stopped without injuring the hand or animal, but also without breaking a fan blade, which could lead to the dangerous rotational unbalance situation described above.

For the purposes of the present invention, another key consideration in choice of fan blade material is sound dampening. For this, wood is often an optimal choice of high tensile strength (with radial orientation of the wood grain) and natural sound dampening. Still another aspect in choice of material is flexibility in cases where it is desirable for the blade to flex slightly due to aerodynamic forces on the blades, thereby affecting the airflow and also noise production.

Pitch—Applicants have found that varying the fan blade pitch (also known as helix angle for fans and propellers, or angle of attack for wings) is the simplest and most direct way of controlling both airflow and noise production. Since the fan blades of the invention operate as airfoils, considerations of aerodynamic stalling come into play at a certain pitch angles and speeds. Once the fan blades stall, due either to very high pitch, or low speed at smaller pitch angles, the level of noise production may increase substantially while the volume of airflow may decrease. This is illustrated by the combined curves 160 and 162 in FIG. 1. Curve 160 characterizes a fan operating with the blades not-stalled, thereby producing less noise and more airflow. Curve 162 represents a fan operating in the stalled condition, thus producing proportionately more noise for less airflow. Mechanisms for manually or automatically varying the blade pitch of fans during rotation are known in the art. For some flexible fan blade designs, a certain amount of variation in blade pitch may occur by flexing, either over the full span of the blade or segmentally.

Camber—This is the curvature of the blade relative to the simple flat fan blades of much of the prior art. Again, considerations of camber arise from efficient airfoil design (for both wings and propellers). Upper camber represents the curved shape of the blade on the opposite side from the direction of fan airflow. The most sophisticated fan blades of the invention will have a second, lower, camber on the bottom side of the blade—the side which impacts the air as the fan rotates. Again, as for airfoil and propeller design, moderate amounts of camber may increase the lift, corresponding to more airflow for a fan. This correspondence is derived from Newton's Third Law of Motion: "for every action there is an equal and opposite reaction." In this case, an increase in lift (the "action") for an airfoil arises from the motion of the air downwards (the "reaction") which, for a fan, is the volume of air moved by the blades. Thus, more lift for a wing corresponds to more airflow for a fan. Camber may vary from the root of the fan blade (where it attaches to the hub) out to the tips of the fan blade.

Span—This is the diameter of the fan blade assembly. Mechanical mechanisms, manual and/or automatic, may be used to vary the span during rotation of the fan. A larger span will generate larger airflows, other factors being equal.

Chord—This is the width of the fan blade azimuthally (i.e., circumferentially around the direction of rotation). Mechanical mechanisms, also either manual and/or automatic, may enable the variation of chord of the fan blades during rotation. The relation of chord to volume of airflow and noise production, in general, is that larger chords lead to proportionally higher airflows and also higher noise production. The chord may vary from the root chord (at the fan hub) out to the tip chord (at the outer edges of the blades).

Aspect Ratio—This is the ratio of the span to the chord, and variations of the aspect ratio will affect both the airflow and noise generation differently.

Sweep Angles—This is the angle of the blade relative to a line extending radially outwards from the root of the fan blade. This is a familiar concept from comparison of propeller planes to nearly all jet planes. In general, a swept-back blade will have reduced drag at high speed, which for fans may correspond to reduced noise for a given airflow, i.e., moving within region 106 in FIG. in a direction parallel to the C-to-B axis.

Dihedral—For fans, dihedral corresponds to a conical surface containing the blades. A set of blades extending radially outwards from the hub will have zero dihedral angle, while blades falling on a conical surface angled away from the flow direction will have positive dihedral, and blades angled into the flow direction will have negative dihedral. Dihedral angle can have many effects on fan performance, including the flow distribution, amount of flow, concentration of the flow (i.e., how much of a solid angle the airflow subtends), and also the level of noise production for a given airflow.

Flaps—Flaps tend to increase the amount of lift (volume of airflow), but typically at a loss in lift-to-drag (meaning the noise production may increase faster than the airflow)—in FIG. 1, thus may correspond to a line angled up and to the right, with curvature upwards, e.g., curves 152 and 154.

Winglets—Winglets were introduced on wings to reduce the amount of energy dissipated in tip vortices. For the case of fans, this would represent a noise reduction for about the same amount of airflow—this would represent a more vertical downward-directed line in FIG. 1.

Number of Working Blades—As will be seen for embodiments 1 to 3, the number of blades will interact with the number of petals to determine the basic repetition rate for noise generation. For example, in FIG. 5 (embodiment #1) and 11 (embodiment #3), a two-blade fan assembly is shown, interacting with petal assemblies having three petals. Thus for every 360° rotation of the fan blade assembly, each fan blade will pass by each of the three petals, giving a total of six blade-petal interactions, or one interaction every 60° —FIG. 10 illustrates the noise production over this 60° interval as the pressure wave from a blade (mostly in front of it) encounters a shaped petal of the invention to produce a desired nearly sinusoidal pressure rise and fall. To the extent that this curve is sinusoidal, it will have minimal higher harmonics and thus will produce a pleasing pseudo red noise spectrum. See the discussion of FIG. 9, below for more detail.

Characteristics of the Noise Production of the Rotating Blades. Before proceeding to considerations of increasing the amount of noise (volume) produced by fans of the invention, it is important to consider what types of noise are produced by the fan blades. For the considerations of fan design, turbulence may be expected to produce most of the noise, especially the higher frequencies, relative to laminar flow (i.e., flow which remains attached to all, or nearly all, the surface of the airfoil). Higher frequency noise constitutes the less desirable components of "white noise," distinguishing it from the more pleasing red noise. Stalling is the ultimate example in which the airflow detaches very close to the front of the upper camber of the blade, thus producing the most noise and least airflow. For fan design, this corresponds to region C and curve 162 in FIG. 1. Thus the aerodynamic fan blades of the invention will tend towards more pleasing red noise production.

Increasing the Amount of Noise with Minimal Effects on Airflow—Moving Out of Regions A and B into Regions C and D The design of fan blades according to preferred embodiments of the present invention allows blades to operate over a wide range of airflow volumes while producing minimal noise. This capability exceeds that of the prior art, exemplified by curves 120, 130 and 140 in FIG. 1 where there is no independent control of noise relative to airflow. In the prior art, a fan user wanting more cooling air is forced to accept whatever level of noise production inherently accompanies an increased fan rotation speed. Conversely, a fan user wanting a quieter fan is forced to accept whatever remaining airflow is produced at a lower fan speed. A fan according to embodiments of the invention, however, may operate as low as curve 112, the bottom edge of region 106, where increasing the fan rotational speed may have minimal effect on noise production. Further, overall noise production (due to the aerodynamically-efficient fan blade design) is less than prior art fans at any airflow rate.

Applicants have found that one way to increase noise production is to operate with fan blades having added features which tend to roughen the blade (such as flaps extending from the edges of the blades) but do not have a large reducing effect on airflow. These features may be attached either to the fan blades themselves, or within the airflow field produced by the fan. According to some preferred embodiments of the present invention, proximity devices such as a secondary set of blades or petals rotating due to vortex content in the airflow (due to the rotation of the fan) or their own aerodynamic helix angle may add both additional noise and noise tonal modulation as well as visual appeal, similar to a kinetic sculpture. Alternatively, these proximity devices may be mechanically powered either by the fan motor, or another motor.

In the preferred embodiments described herein, the largest increases in noise volume were produced by the addition of such "proximity elements," i.e., structures which can be moved to a controlled distance near the plane of rotation of the fan blades to interact with the pressure wave produced by each moving fan blade. For example, as illustrated in FIGS. 3-9 and 11-12, a "petal assembly" in proximity to the rotating fan blades can be used to partially impede the smooth rotation of the pressure wafer induced by the fan blade moving through the air. Improper petal design will produce hard "thumping" having many high frequency components, which thus deviates from a red noise spectrum. More smooth curved shapes for the petals (and also potentially for the edge of the fan blade which passes closest to the petals) will produce more nearly sinusoidal pressure rise and fall curves, as illustrated by the calculated data in FIG. 9, which correspond to the more desirable pseudo red noise. In order to vary the noise levels produced, the spacing between the petals assembly may be manually or automatically changed to control the degree of interaction between the fan pressure wave and the petals—see spacings 320 and 322 in FIGS. 5A and 5B. The noise produced by the addition of such proximity elements will of course be in addition to the usual noise produced by operation of the fan and blades by themselves.

A tapered enclosure around the blades having openings spaced around the circumference can have a similar effect to the petals assembly, although the interaction is more with the fan blade tip vortices than with the bulk of the fan airflow. The interaction will have a base frequency dependent on the number of fan blades and the number of openings. In order to vary the noise levels produced, the position of the tapered enclosure relative to the plane of the rotating blades may be manually or automatically changed. Due to the taper in the enclosure, this axial motion changes the spacing between the inner diameter of the enclosure and the outer edges of the fan blade, thereby controlling the degree of interaction between the fan pressure waves and the openings in the enclosure. Alternatively, instead of a moving tapered enclosure to vary sound production, variable span fan blades may be employed with a cylindrical or tapered enclosure to adjust the radial spacing between the inner diameter of the enclosure and the tips of the fan blades without motion of the enclosure.

Other proximity devices are also possible within the scope of the invention. Prior art fan design generally teaches methods for reducing the production of noise for any given airflow, but not increasing the noise production or controlling the ratio of noise production to the volume of airflow.

Where any such proximity devices are employed, the volume and frequency of noise produced will be affected by the base repetition rate. For example, a three-bladed fan and a tapered enclosure with five openings will have a base repetition rate of 3×5=15 per cycle. Note that the repetition rate will be the Least Common Multiple (LCM) of the number of fan blades and the number of openings in either the tapered enclosure or the number of petals.

Preferred embodiments of the present invention may also include additional sound producing devices. Some embodiments of the invention include positioning resonant structures within the flow stream of the fan, such as horns (e.g., a "didgeridoo," fipple, fluid-filled bulb, wind chimes, strings, flute, reed, etc.), or a sound box as in an acoustic guitar. Sound amplification of at least 2× is possible without the need for any electronic amplification. Clearly, such resonant devices may be designed to enhance the production of low frequency relative to high frequency sounds, thereby more closely approximating the pleasing red noise spectrum.

Further, some embodiments of the invention may include an automatic timer, enabling a fan user to preset the turn-off time (e.g., in the morning to prevent unattended operation in daytime), or the turn-on time (e.g., before the fan user expects to arrive home in the evening). Automatic operation in some embodiments may also include control by an audio and/or visual sensing circuit. This may involve sensing the beeping of a smoke alarm or a loud noise characteristic of the breaking of a window or the falling down of large furniture. Visual detection of the characteristic light emission from flames can trigger the fan turning off in some embodiments—this has the dual advantages of reducing the airflow which might "fan the flames," while also alerting the fan user to an imminent danger.

Noise Frequency Distributions

Figure 2:
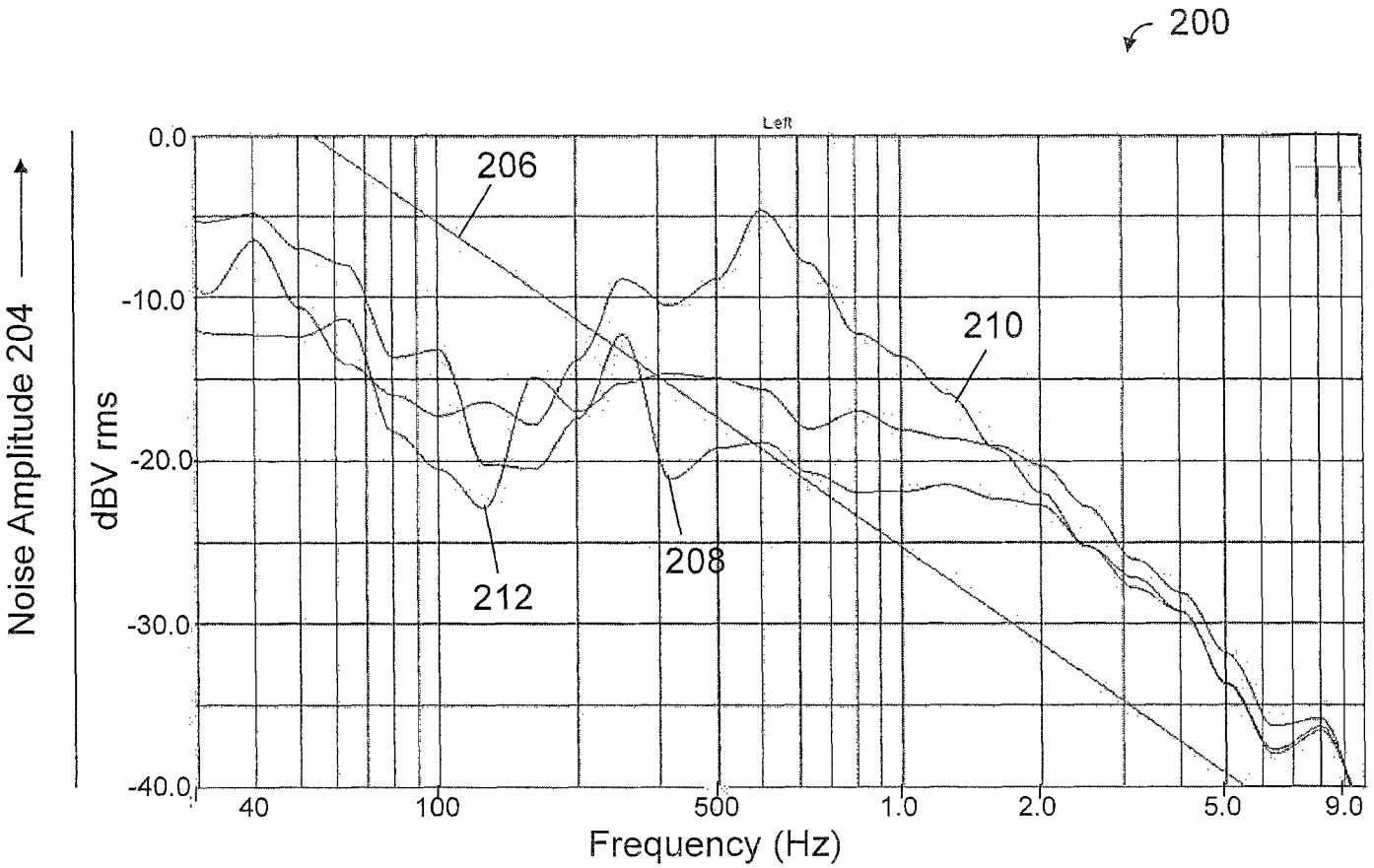
FIG. 2 is a graph of noise amplitude relative to the noise frequency.

FIG. 2 is a graph 200 of noise amplitude 204 relative to the noise frequency 202. Curve 206 represents exact "red noise," i.e., a noise spectrum decreasing by 20 dB for every 10× increase in noise frequency. This is to be compared with "white noise" which amplitude is, in principle, independent of frequency. It has been demonstrated in the prior art that people find a red noise spectrum to be a "pleasing noise." Thus it is a purpose of some embodiments of the present invention to provide a design method and fan structure which produces a noise spectrum similar to that of a perfect red noise spectrum. The invention produces this approximation to red noise through the design of the fan blades, and, in some embodiments, through the design of a "petal assembly" which is in proximity to the fan blades, at a distance which is preferably variable to adjust the sound intensity, without the use of electronic sound production means. The phrase "electronic sound production means" is used to refer to various methods of electronically producing sound and not to the sound resulting from the operation of the fan itself. In preferred embodiments, the petal assembly (or other proximity device) is located coaxially to the fan blade rotational axis. In other preferred embodiments, the petal assembly could be nominally on axis (for example, located less than 1% from the blade rotational axis) or completely off-axis. A preferred embodiment of an off-axis orientation would be off the rotational axis but having a petal assembly axis that is parallel (or nearly parallel) to the blade rotational axis. In other embodiments, a tapered enclosure surrounds the rotating fan blades to produce a resonant approximation to a red noise spectrum, again purely by means of the mechanical configuration of the fan blades and the design of the enclosure, and without the use of electronic sound production means.

Curves 208, 210, and 212 represent measured noise spectra for various embodiments of the invention, all of which are similar to the perfect red noise curve 206—thus noise spectra 208 (the high-efficiency, tuned fan blade by itself or with petals far away), 210 (embodiment 1 with petals close), and 212 (embodiment 3 with petals close) are termed "pseudo red noise" (PRN) and have been found by the applicants to produce essentially the same "pleasing noise" to fan users as does the pure red noise spectrum 206.

Figure 3:
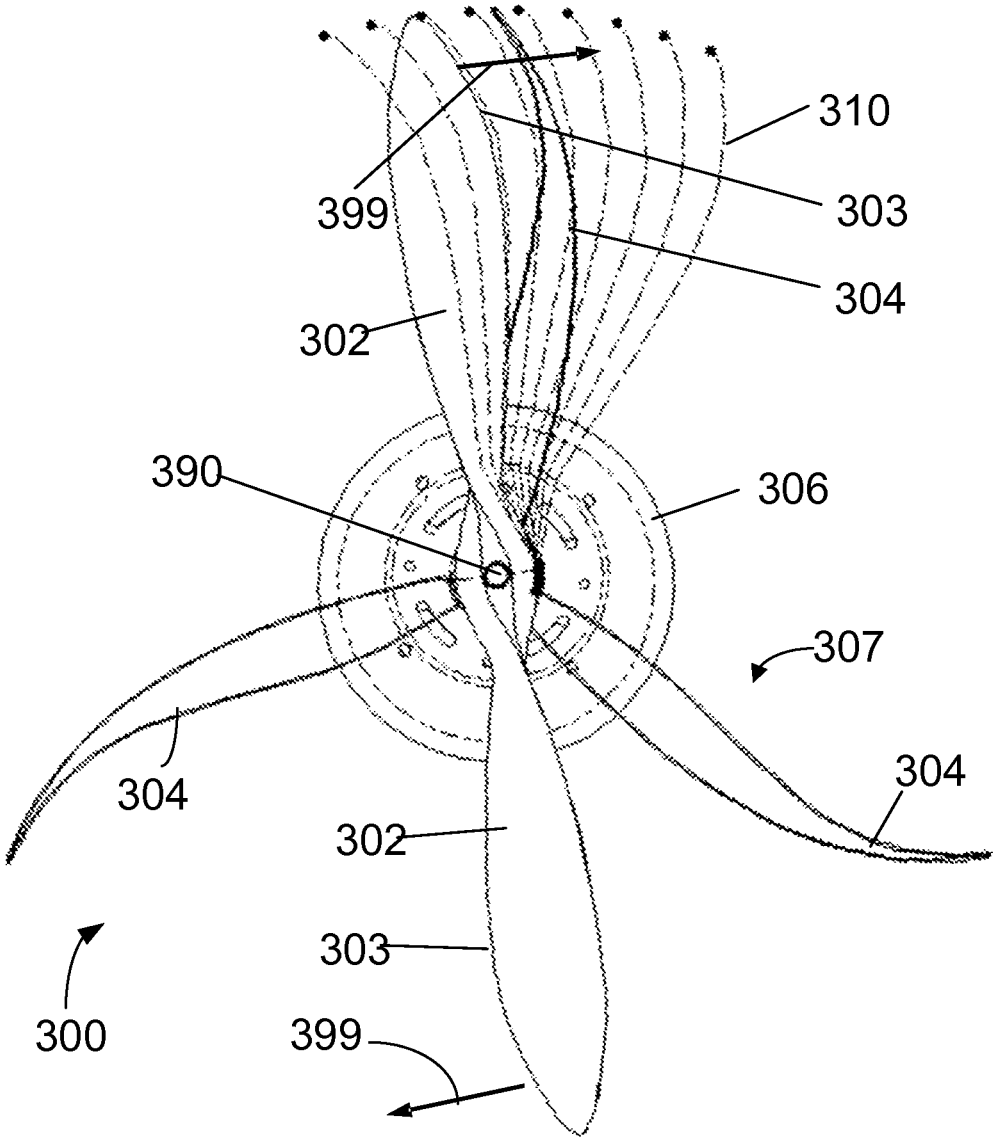
FIG. 3 is a front view of a preferred embodiment of the invention showing the fan blades and petals.
Figure 4:
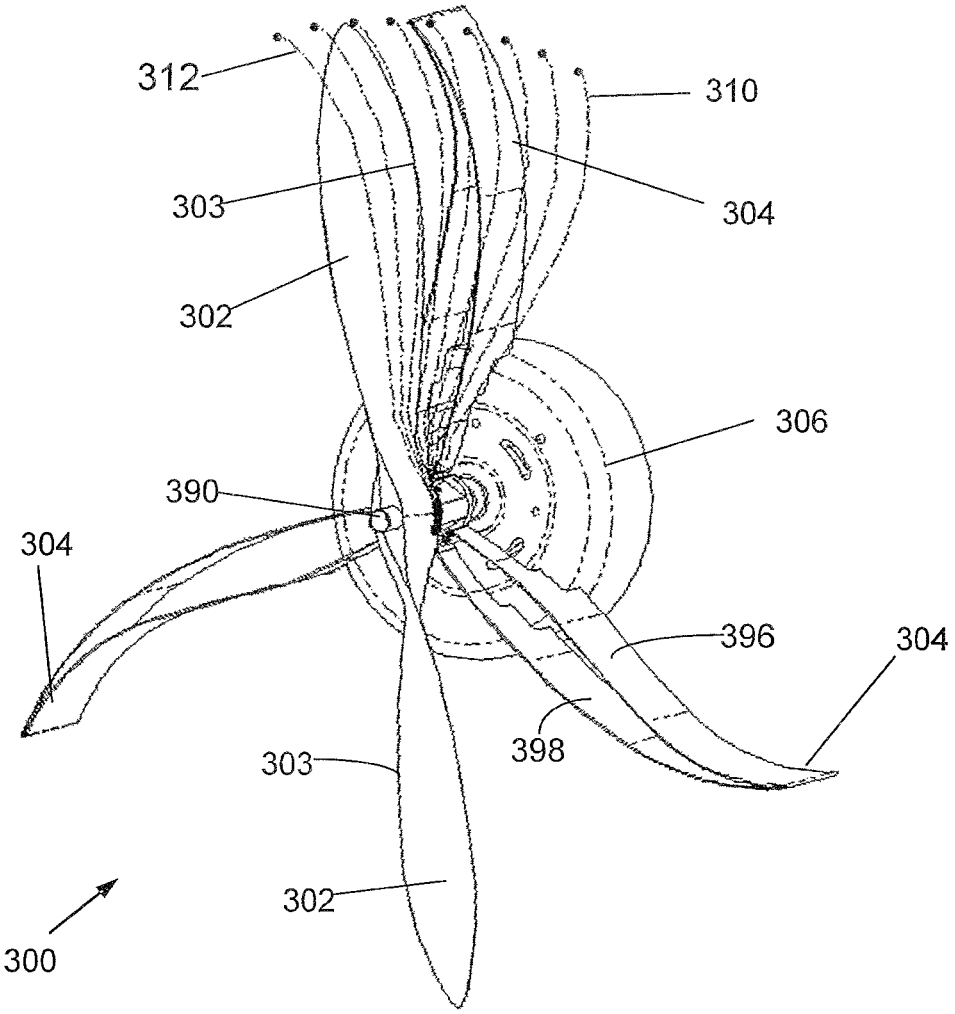
FIG. 4 is a perspective view of the embodiment of FIG. 3.
Figure 5B:
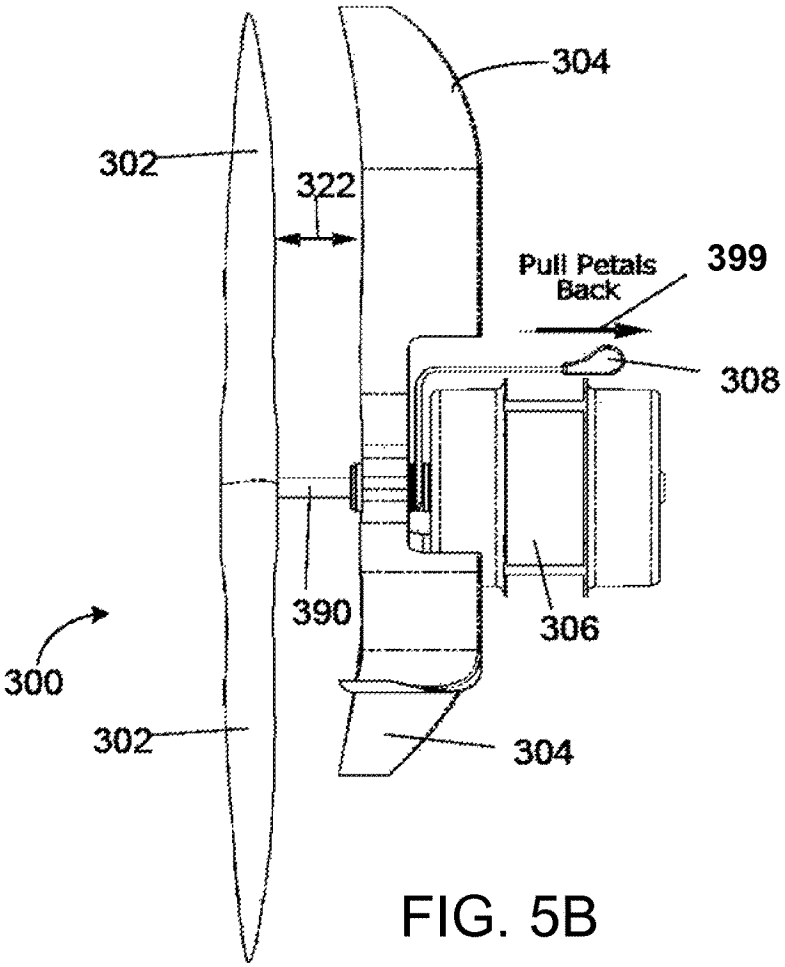
FIGS. 5A and 5B are side views of a preferred embodiment of the invention illustrating the adjustment of the petal position.
Figure 5A:
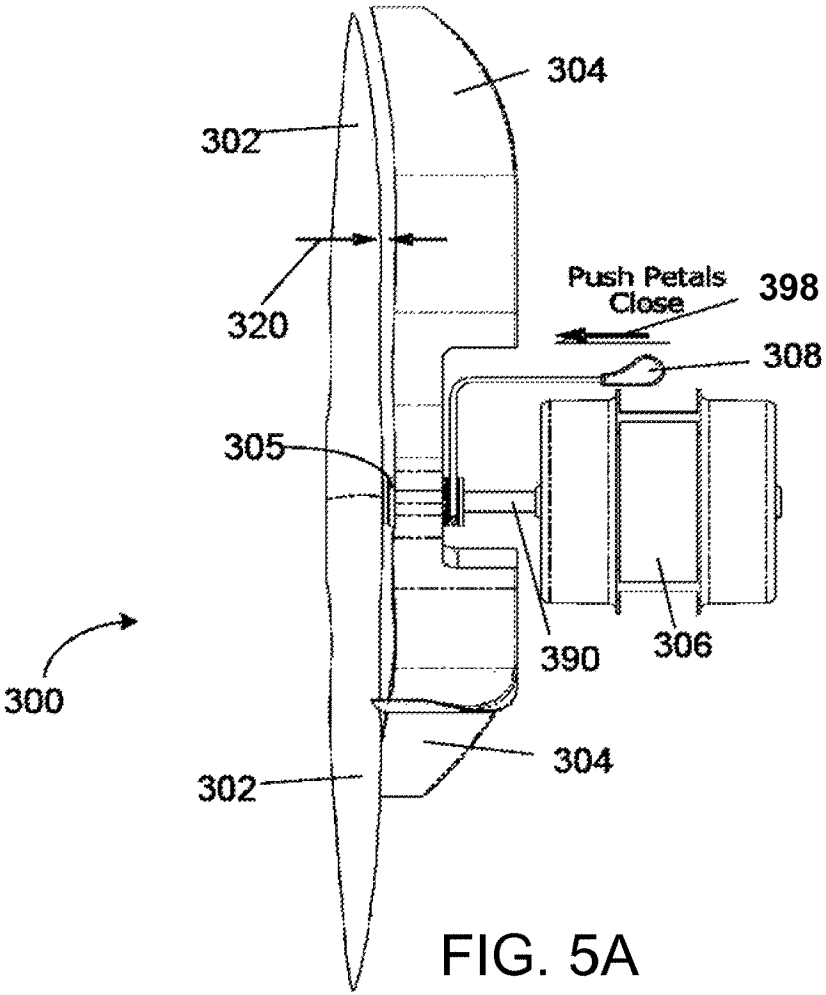
Figure 6:
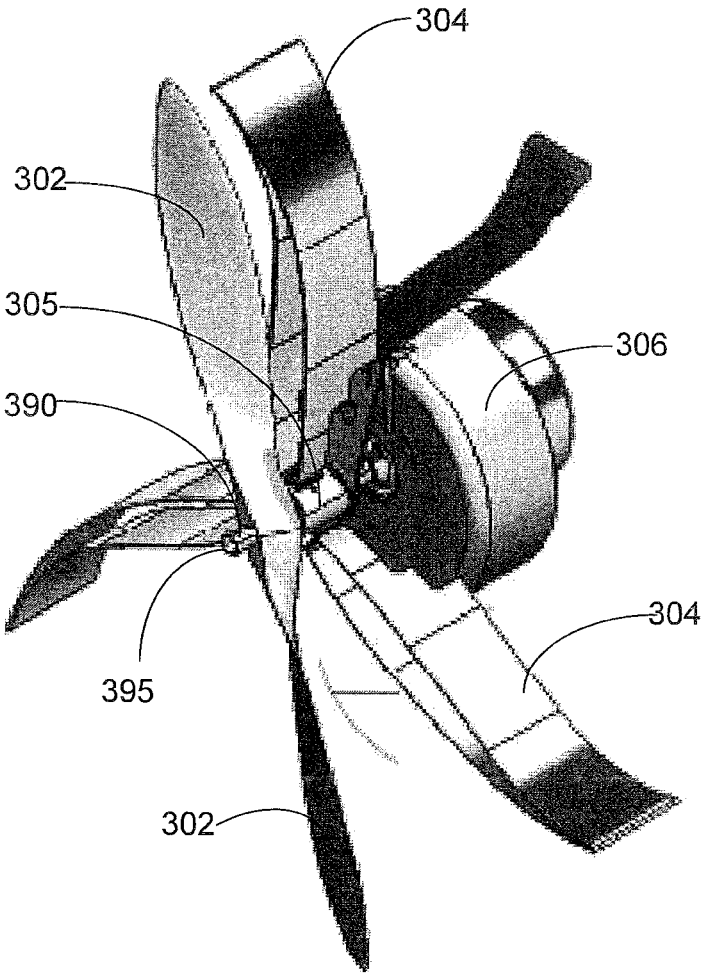
FIG. 6 is a perspective view of the embodiment of FIG. 3.

FIGS. 3-6 show an embodiment of the invention using a proximity device consisting of a three petal arrangement with the petals located behind the fan blades. FIG. 3 is a front view of a preferred embodiment of the invention 300 showing the fan blades 302 and petals 304, while FIGS. 4 and 6 are perspective views of the embodiment of FIG. 3. Motor 306 rotates fan blades 302 which are mounted on shaft 390. Petal assembly 307, in this case comprising three petals 304, slides freely on shaft 390, resulting in slow rotation of the petals assembly in either or both directions, as shown by shaded lines 310. Although many of the figures herein depict clockwise rotation of the fan blades, counterclockwise rotation is also possible. The phrase "leading edge" is used to refer to the edge of the fan blade toward the direction of rotation. Each petal 304 is formed from two thin sheets 396 and 398, as shown, with a gap between them, which are separated through the body of the petal but joined at the tip. The rotation 399 of the fan blades 302 relative to the petals 304 produces the pseudo red noise 210 characterized in FIG. 2. The proximity of the petals to the fan blades is adjusted by a mechanism (see FIG. 7B) which is activated by handle 308.

Petal assembly 307 is mounted on a hub 305 with a center hole 395 which slides on the rotating shaft 390 (see FIGS. 5A and 5B) which turns the fan blades (or a coaxial sleeve). A small amount of friction between the inner surface of center hole 395 in hub 305 may lead to a slower rotation of the petals assembly. This rotation has minimal effect on noise volume but induces a pleasant modulation, and has also essentially no effect on the volume of airflow. This slow rotation, however, has been found to be visually pleasing to fan users. Alternatively, a petal assembly may be mounted in a stationary fashion.

FIGS. 5A and 5B are side views of the first embodiment of the invention illustrating the adjustment of the petal position. In FIG. 5A, the petals have been pushed close to the fan blades. In other words, the adjustment of the petal position has brought the proximal surface of the petals (the surface toward the fan blade) as close as possible to the fan blade itself. This position produces the highest pressure wave and thus the loudest sound intensity. Arrow 398 illustrates the direction of motion of the petals assembly used to increase the amount of noise produced by moving the petals 304 closer to the fan blades 302 and producing spectrum 210 as opposed to spectrum 208 when far away. In FIG. 5B the petals 304 have been moved back from the fan blades 302, which results in a lower pressure wave and lower sound intensity. Preferably, the distance between the fan blades and the petals (or any other type of proximity element) can be adjusted to any point between the closest position and the furthest position to allow for a continuous adjustment of sound level between these two positions. Applicants have found that once the separation between the rotating fan blades 302 and the petals (either stationary or rotating slowly) is greater than the thickness of the petal (extending in the direction parallel to the axis of rotation of the fan blade) that there is little noise enhancing effect from the petals. Arrow 399 illustrates the direction of motion of the petals assembly used to decrease the amount of noise produced by moving the petals 304 farther from the fan blades 302. The level of noise production for some embodiments has been measured to decrease by as much as 25 dB between the positions shown in FIGS. 5A and 5B. FIG. 6 is a perspective view of a preferred embodiment of FIG. 3.

Figure 8:
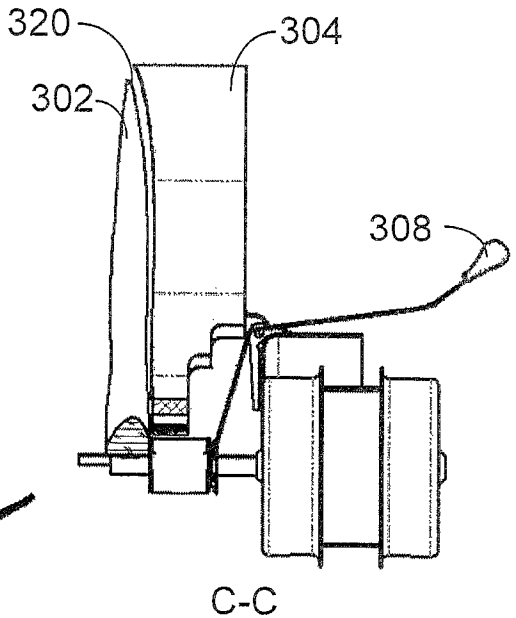
FIG. 8 shows a cross sectional view of the embodiment of FIG. 3.
Figure 7:
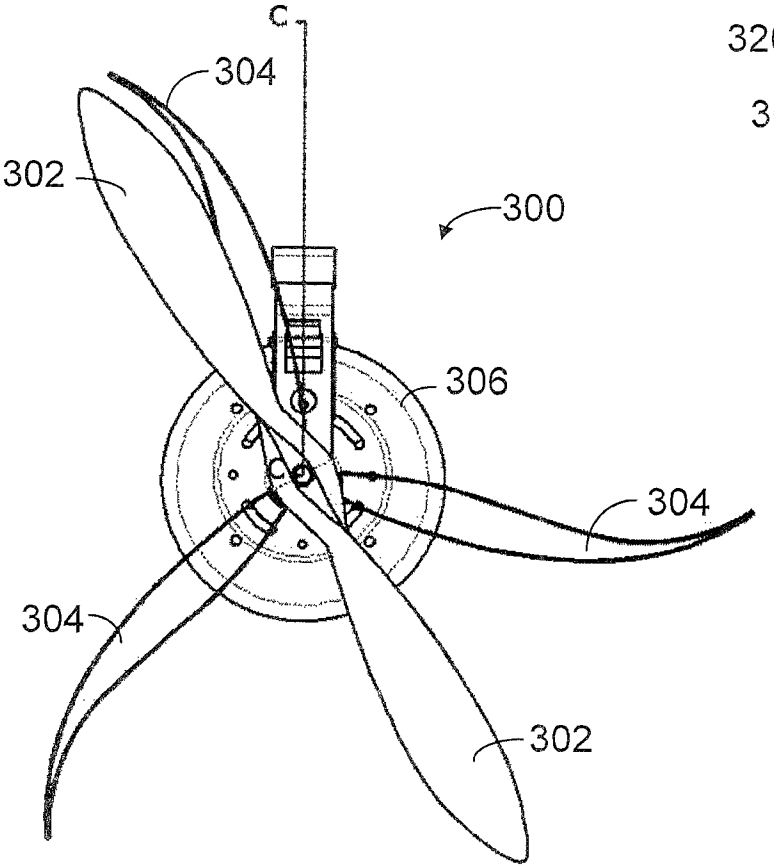
FIG. 7 shows a front view of the embodiment of FIG. 3.

FIG. 7 shows a front view of the embodiment of FIG. 3, while FIG. 8 shows a cross sectional view along line C-C. The distance 320 between blades 302 and the front curvature of petal 304 can be as little as 1 mm in some preferred embodiments.

Applicants have found that the more abrupt interaction that happens when petal shapes are similar to the leading edge outline 303, tends to produce more rapid pressure change as the fan blade nears the petal, and more rapid pressure reversal as the fan blade moves beyond a petal. Such abrupt rises and falls in pressure produce sound waveforms similar to square waves, which are well-known to be characterized by a broad spectrum of higher-order harmonics (concentrated on odd harmonics). This will clearly result in a noise spectrum with increased high frequency noise (from the higher harmonics) which will consequently undesirably deviate from the red noise, or pseudo red noise, spectrum found to be most pleasing by fan users.

Figure 9:
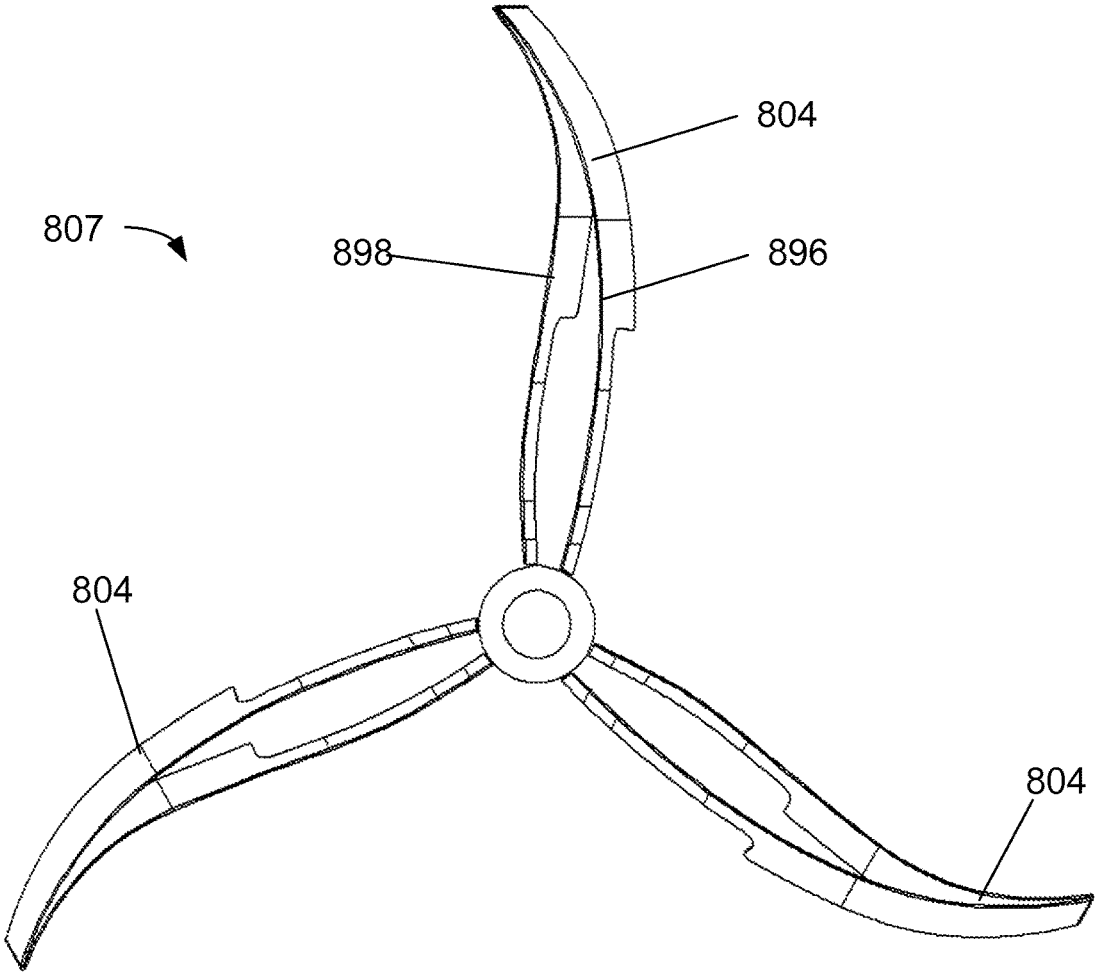
FIG. 9 is a front view of a petal assembly of another preferred embodiment of the present invention.
Figure 10:
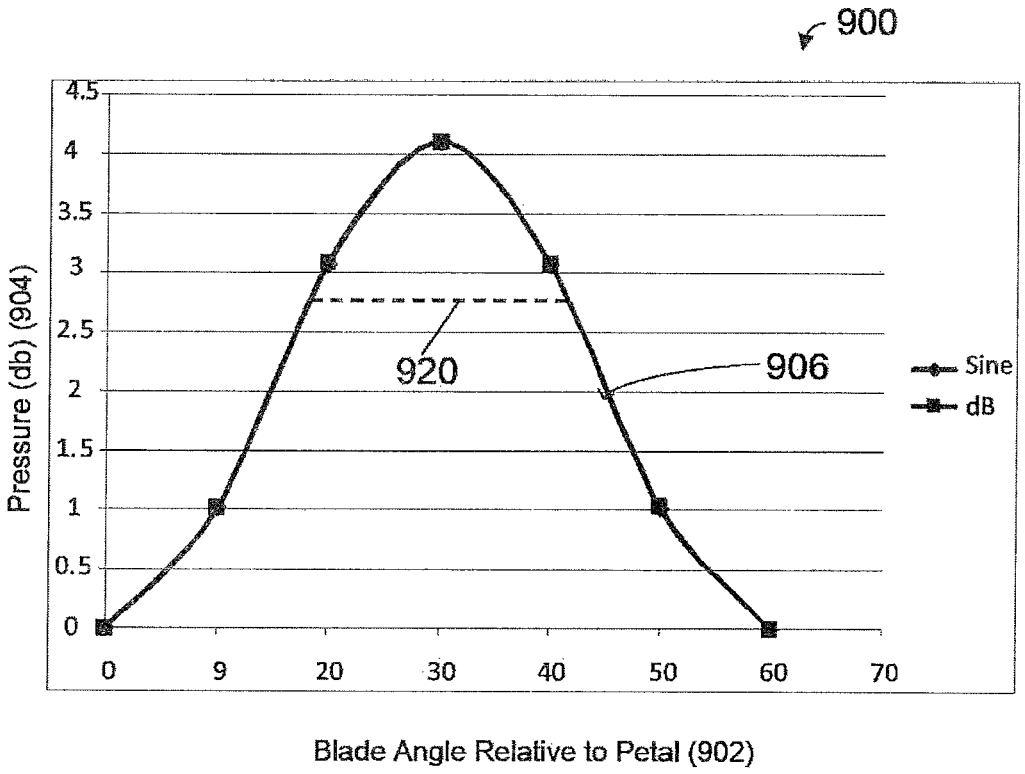
FIG. 10 is a graph of the sound pressure (in dB) as a function of the angle of the fan blade relative to the petals assembly in the second embodiment.

FIG. 9 is a front view of a petal assembly 807 similar to the one shown in the preferred embodiment shown in FIGS. 3-7. Like the petal assembly of the first embodiment, each petal comprises two thin sheets 896 and 898, as shown, with a gap between them. In addition, however, Applicants have discovered that twisting the ends of the petals 804 as shown in FIG. 9 into a helix angle enhances the rate and definiteness of the rotation of the petals. By varying the helix angle and the pitch, the petal assembly can be made to spin at a desired speed, ranging from speeds higher than the blade speed to counter-rotation in the opposite direction from the blades.

FIG. 10 is a graph 900 of the pressure (sound) in dB (on y-axis 904) as a function of the angle of the fan blade relative to the petals assembly (on X-axis 902) in the first preferred embodiment. Curve 906 has the desired pseudo-sinusoidal shape producing the least amount of higher harmonics (that is, it matches the ideal sine wave so closely as to be indistinguishable), and thus a noise spectrum that has been shown to be pleasing to the fan user. Dashed line 920 represents a case where the petals do not produce a fully sinusoidal pressure waveform as the fan blade passes. Such "clipping" of the pressure waveform will inevitable produce higher harmonics (largely odd-order), all of which would not be nearly as large in the preferred pseudo red noise spectrum. Extensive experimentation with the shapes of petal 804 has enabled the generation of curve 906 for embodiments of the invention to avoid this undesirable clipping. All of the embodiments described herein have been tuned using pressure wave calculations based upon petal geometry and distance from the blades to produce a preferred pseudo-sine wave such as shown by line 906.

Figure 11:
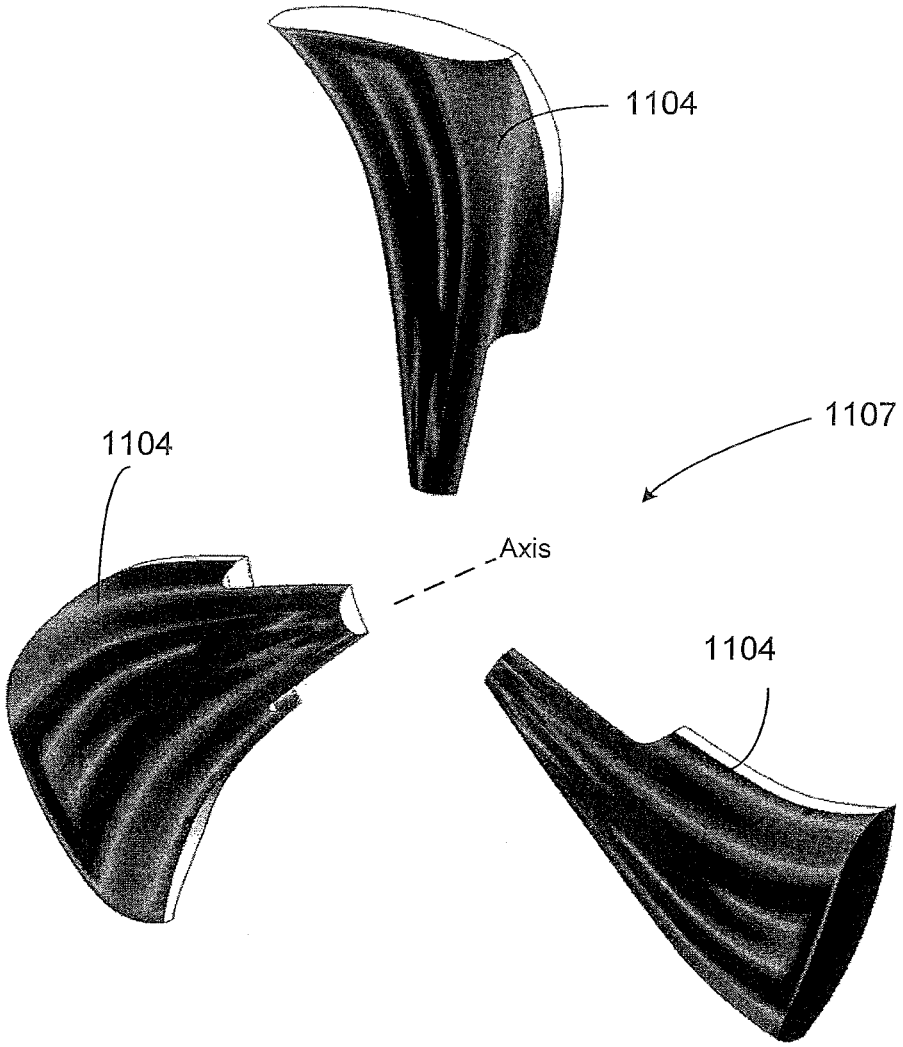
FIG. 11 is a perspective view of the petal assembly in another preferred embodiment of the invention.
Figure 12A:
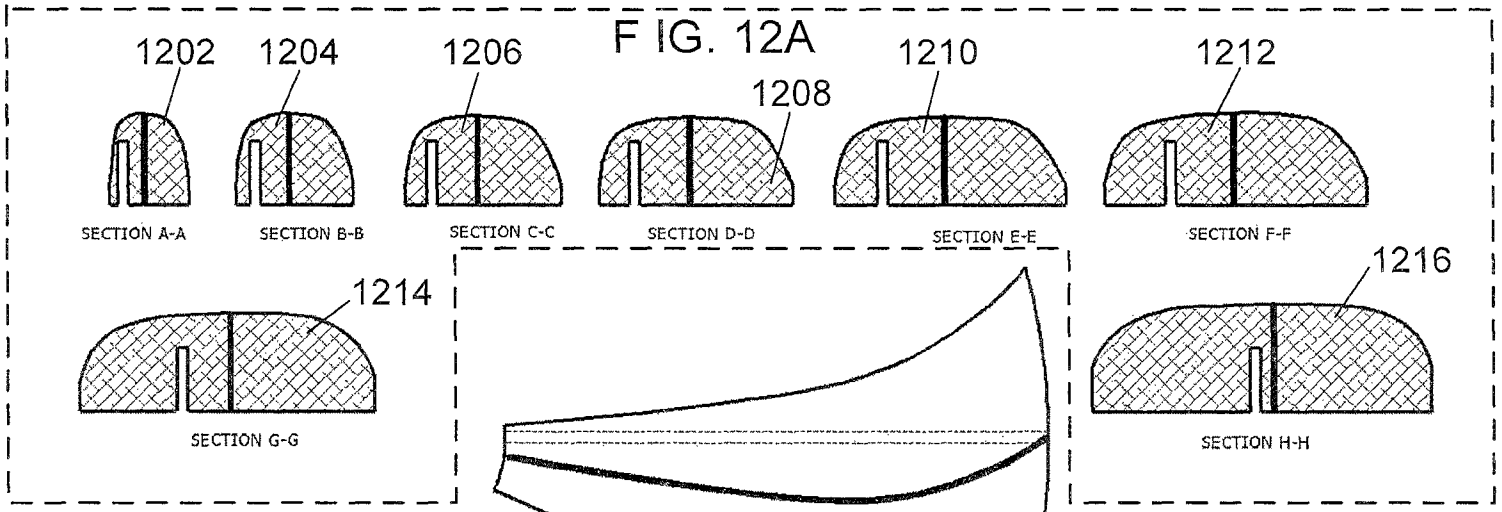
FIGS. 12A, 12B, 12C, 12D and 12E is a set of views and cross-sections of the petals assembly of FIG. 11.
Figure 12B:
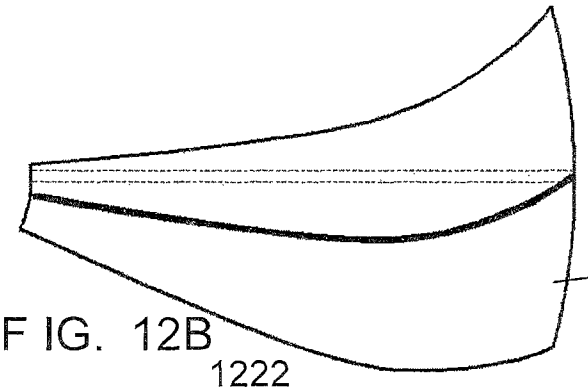
Figure 12D:
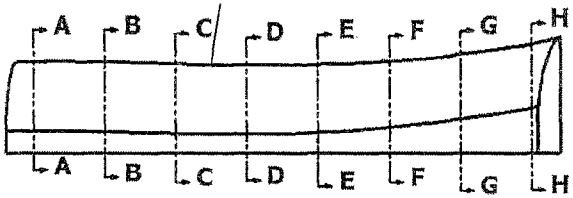
Figure 12C:
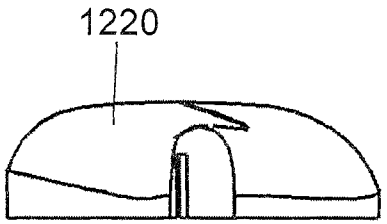
Figure 12E:
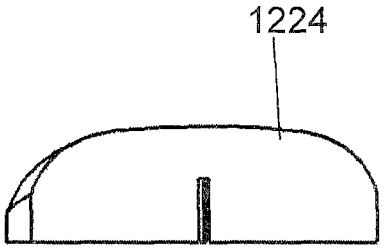

FIGS. 11 and 12 show an alternative embodiment of a petal assembly according to the present invention. FIG. 11 is a perspective view of the petals assembly 1107 in another preferred embodiment of the invention. For this second embodiment, each petal 1104 has a complex shape that was computer generated based upon pressure wave calculations as described above so that the geometry of the petal resulted in a match to the desired theoretical sine wave of FIG. 9. Petals 1104 can be attached to a hub assembly (not shown) having the same axis 1166 as the blades, similar to that in the first embodiment, or can be mounted in a stationary fashion.

FIG. 12 is a set of views and cross-sections of the petals assembly of FIG. 11. Views 1202-1216 correspond to cross-sections A-A to H-H on view 1222. View 1220 is an end view of the base of the petal (where it mounts on the hub), while view 1224 is an end view of the outer end of the petal 804. View 1218 is from the side of the petal facing the fan blade, and illustrates the complex curves of the front and back edges of the petal. Cross-sections 1202-1216, and the two end views 1220 and 1224, all illustrate the curved shape of the side of the petal facing the fan blade—this curved shape produces the desired pseudo-sinusoidal pressure rise and fall, as was discussed for the first embodiment in FIG. 5.

Figure 13:
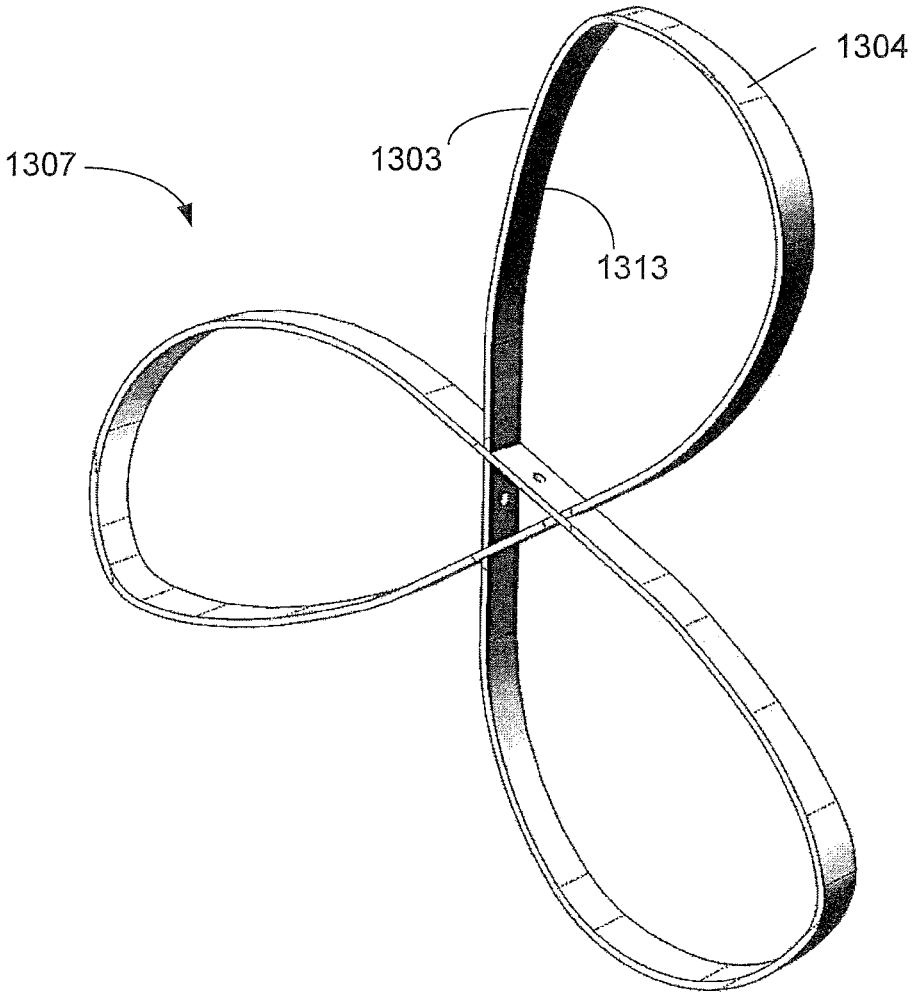
FIG. 13 is a perspective view of a clover-leaf style petal assembly 1300 for use in another preferred embodiment of the invention.

FIG. 13 is a perspective view of a preferred petal assembly 1307 for use in another embodiment of the invention. For this embodiment, each petal 1304 comprises an open loop, with a front edge 1305 and a back edge 1315—the front edge is the side of the "cloverleaf" petal 1304 which the leading edges 1303 of each fan blade 1302 pass by first during rotation around shaft 1390. Rotation is clockwise as indicated by arrows 1399, thus the leading edges of fan blades 1302 are the nearest part of the blades 1302 to the petals 1304. The curved shapes of the front 1303 and back 1313 edges of cloverleaf petals 1304 have been developed to produce the optimal pressure wave rise and fall, in a similar process as was used to produce the shapes of petals 304 and 804 in the first and second embodiments, except that the peak of the sine is reached mid-radius rather that at the tip. In preferred embodiments, petals 1304 could be formed, for example, from sheet aluminum.

Figure 14A:
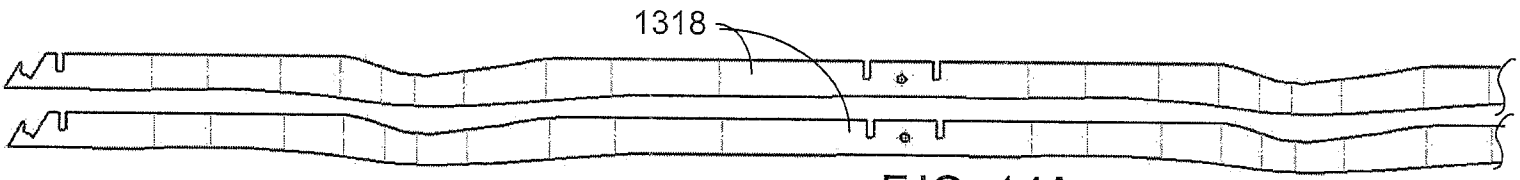
FIG. 14A shows two material strips that can be used to form the petal assembly of FIG. 13.
Figure 14C:
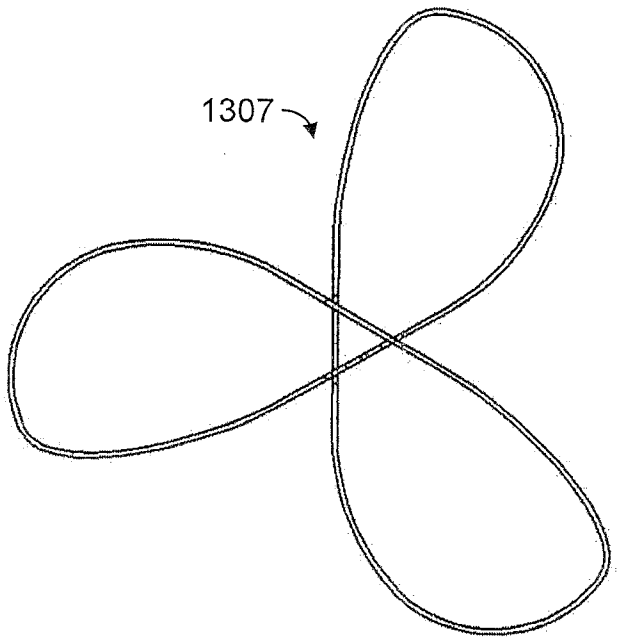
FIGS. 14B to 14C show side and front views of the petal assembly of FIG. 13.
Figure 14B:
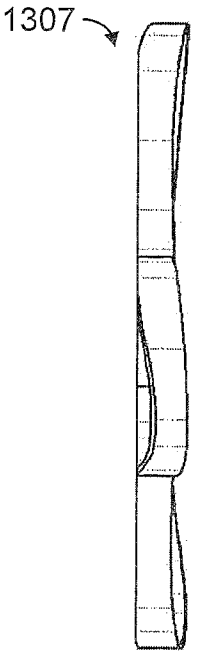
Figure 15:
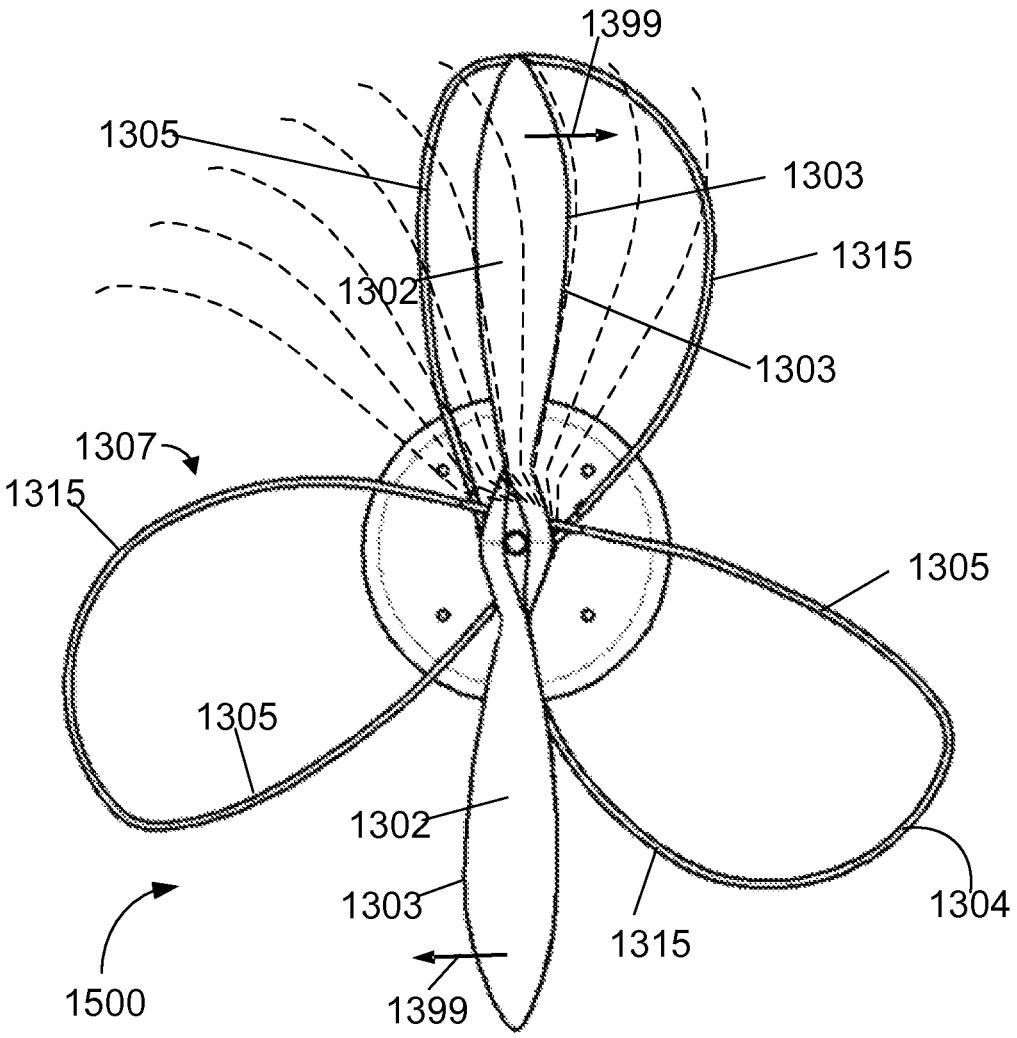
FIG. 15 shows the petal assembly of FIG. 13 mounted coaxially behind a fan blades.

FIGS. 14B to 14C show side and front views of petal assembly 1307. The petal assembly can be formed by forming the strip 1318 partially, shown in FIG. 14A. Only the left ends of strips 1318 are shown. The remaining portions would be identical, with each completed strip having three sets of the features shown. FIG. 15 shows a preferred fan assembly 1500, with petal assembly 1307 mounted coaxially behind (upstream from) blades 1502.

Figure 16:
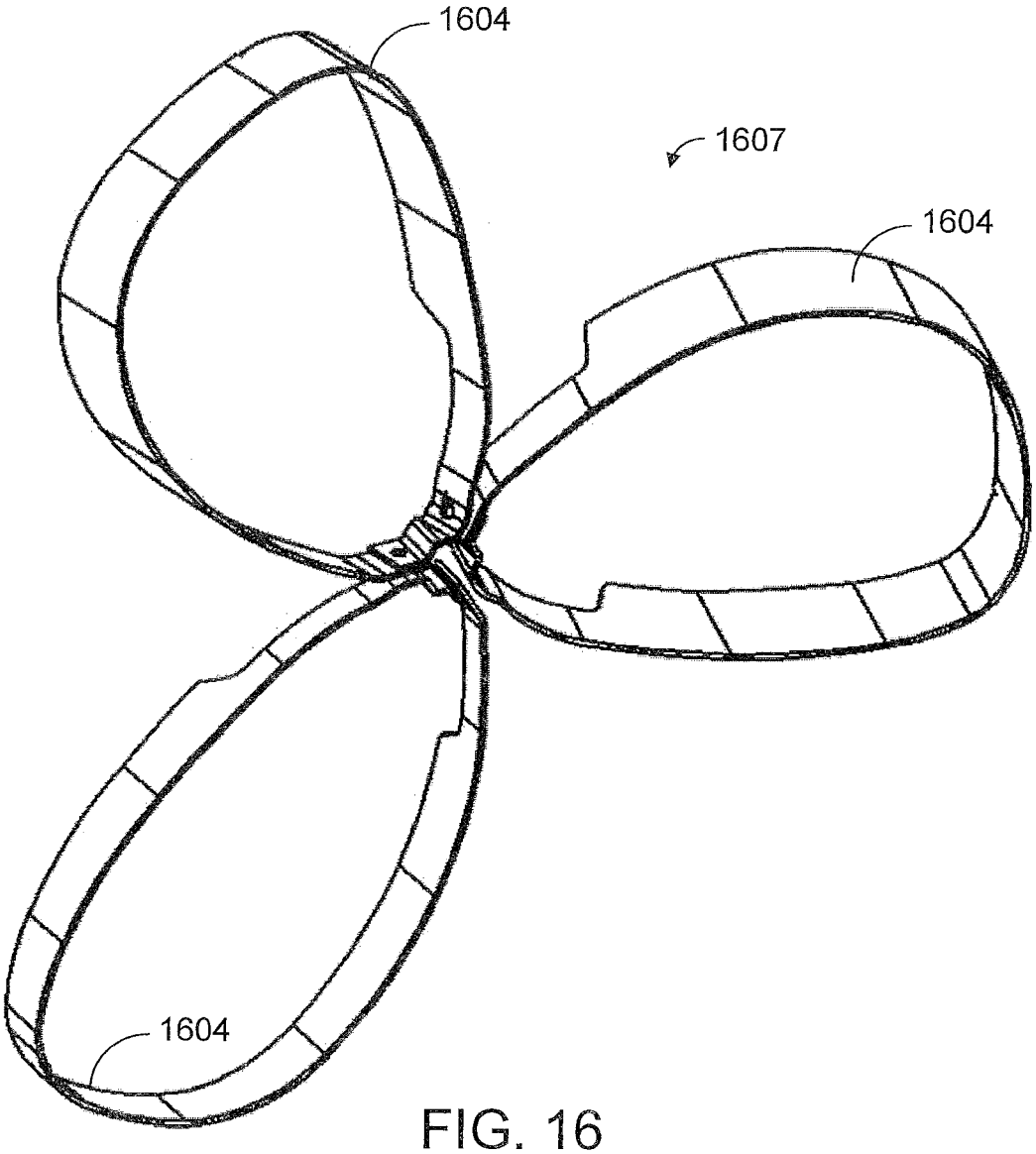
FIG. 16 shows another preferred embodiment of a petal assembly according to the present invention.
Figure 17:
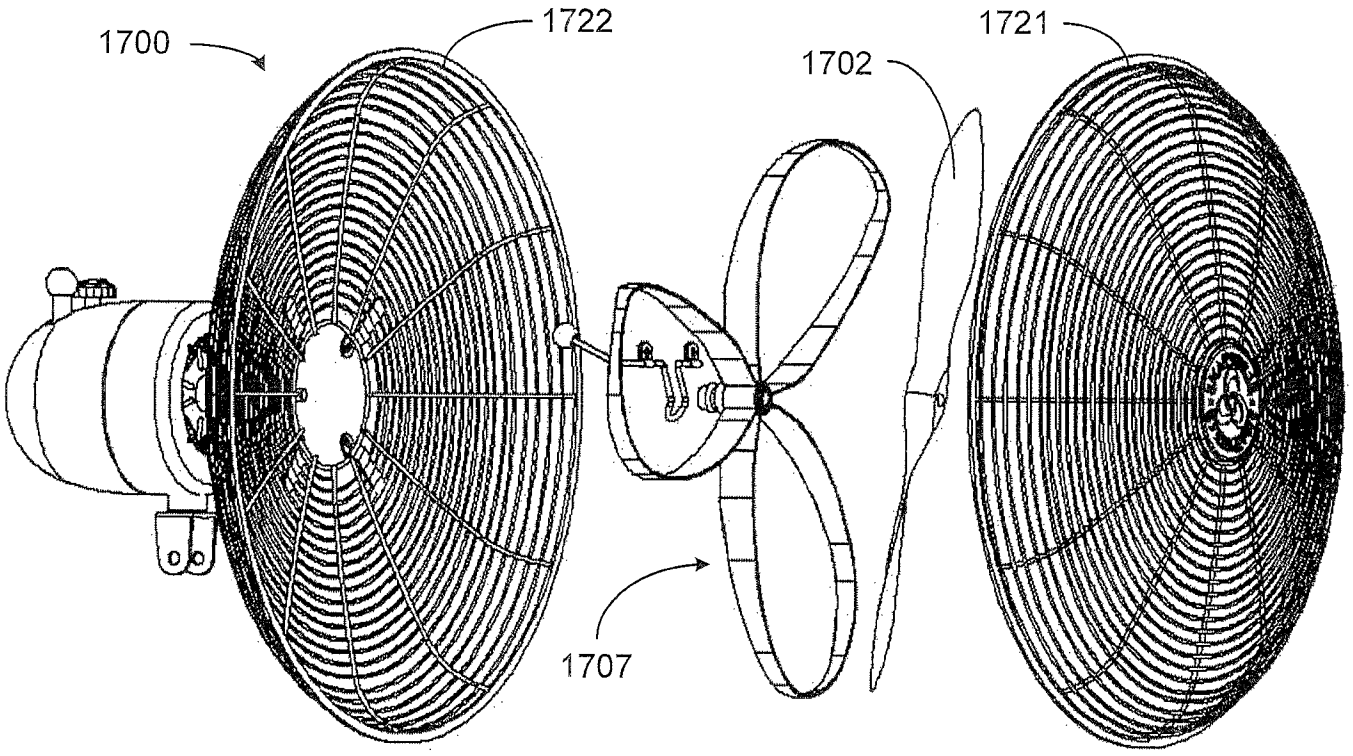
FIG. 17 shows an exploded view of a typical pedestal fan with a fan blade and petal assembly according to the preferred embodiment of FIG. 16.

FIGS. 16-17 show another preferred embodiment of a petal assembly 1607. The petal assembly of FIG. 16 is similar to the clover-leaf design of FIGS. 13-15, except that the petals 1604 are formed individually rather than from one longer flexible strip. Petal assembly 1607 could also be mounted coaxially behind the fan blades as in the embodiment of FIG. 15. FIG. 17 shows an exploded view of a typical pedestal fan assembly 1700 with a fan blade 1702 and petal assembly 1707 according to the preferred embodiment of FIG. 16. Fan assembly 1700 is housed inside front guard 1721 and rear guard 1722.

Figure 18:
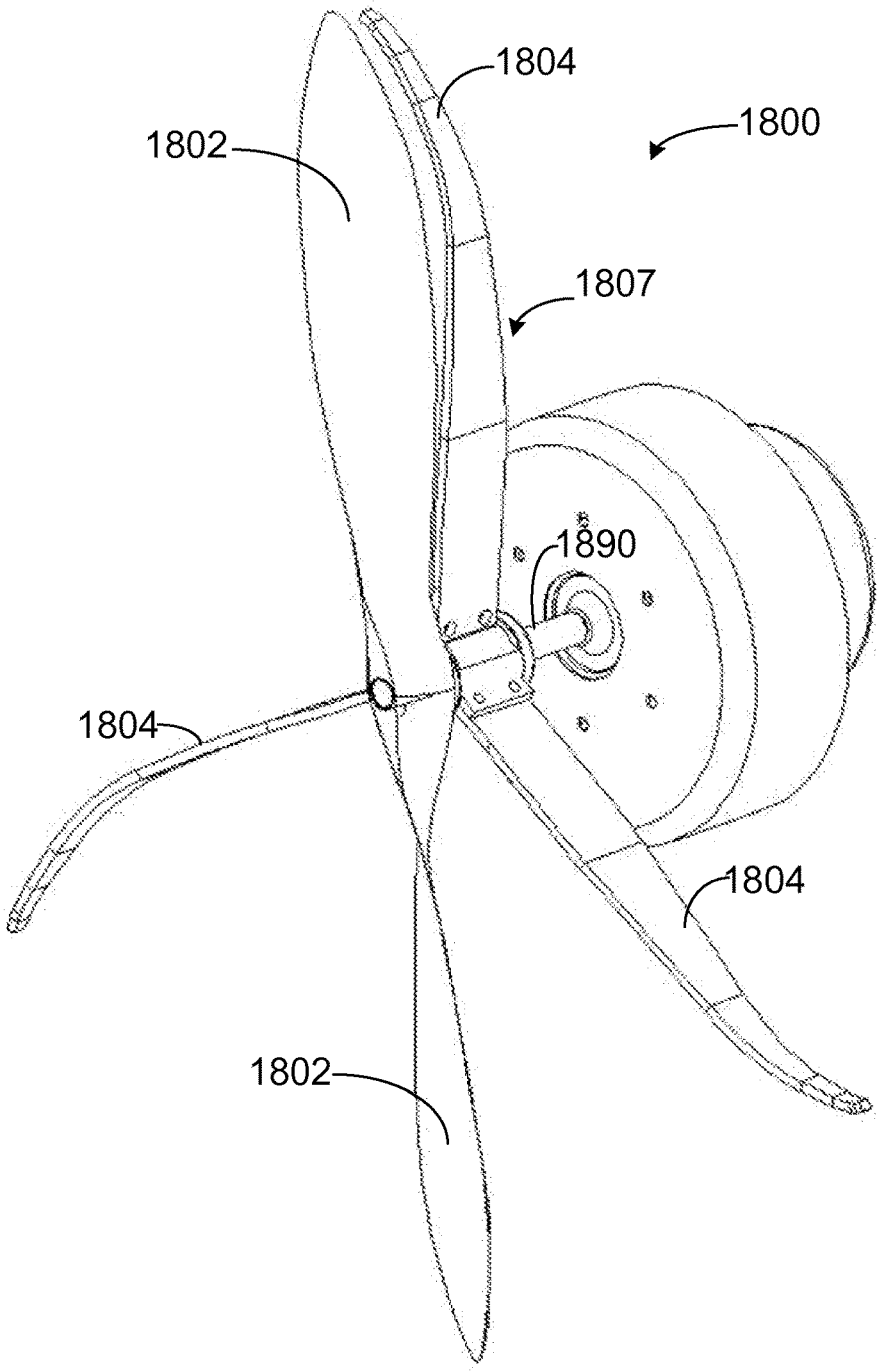
FIG. 18 shows another preferred embodiment of a petal assembly according to the present invention.

FIG. 18 shows another preferred embodiment of a fan assembly 1800. In the embodiment of FIG. 18, the petals 1804 are formed from a solid material, such as wood, aluminum, or plastic, for example. Petal assembly 1807 is especially suited for use with a short fan shaft 1890. The curvature of the petals is also designed to more precisely follow the leading edge of blades 1802. As discussed above, this may result in a somewhat choppy sound from the more rapid pressure change as the blade passes a petal; however, the resulting large pressure wave gives rise to a very loud sound intensity when the petal assembly is in close proximity to the blades.

Figure 19:
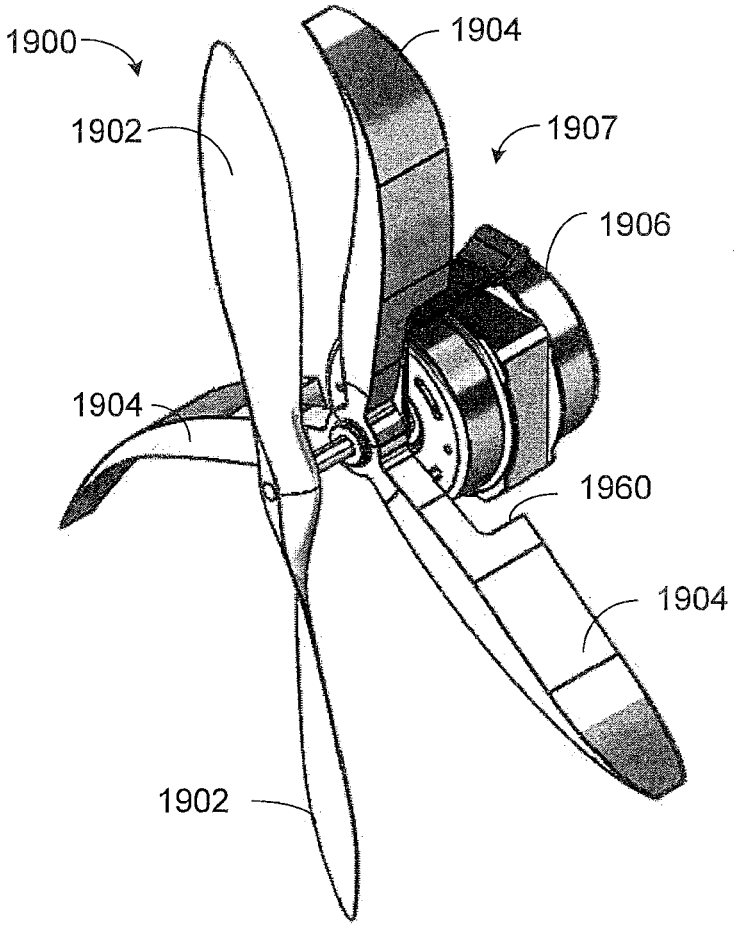
FIG. 19 shows another preferred embodiment of a petal assembly according to the present invention.

FIG. 19 shows another preferred embodiment of a fan assembly 1900 and petal assembly 1907. As in the embodiment of FIG. 18, the petals are also formed from a solid material, such as wood or plastic, for example. However, the petals 1904 follow the shape of a petal assembly similar to the one shown in the FIGS. 3-7, but with the central space filled. Cutout 1960 allows the petal assembly to be moved farther away from blades 1902 without rubbing against motor assembly 1906.

Figure 20:
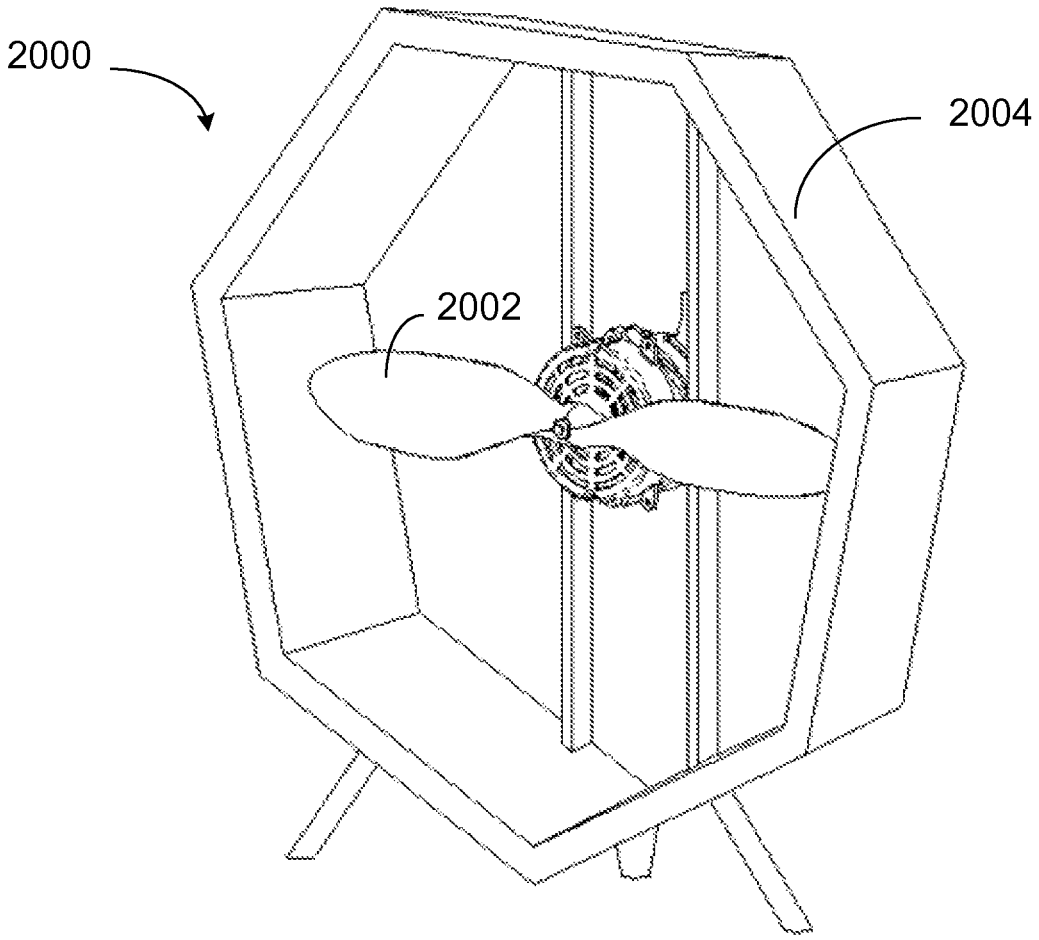
FIG. 20 shows a preferred embodiment of a fan, using an enclosure made up of 7 wooden panels.

FIG. 20 shows a preferred embodiment of a fan assembly 2000, using an enclosure made up of 7 wooden panels 2004. In this embodiment, the proximity effect that produces an increased sound volume is caused by the variation in the distance between the tips of the fan blades 2002 and the inside surface of the panels 2004. When the blade tips are at their closest to the underside of a panel (perpendicular) the pressure wave of the blade is confined, as by the approach of the petal assemblies described above. At the edges of the panels, the pressure wave is not confined, as when the blades pass the petals described above. The result is the same type of proximity effect described above and which can also be used to generate the same type of pseudo red noise. A tapered enclosure could be moved forward or back relative to the fan blades to allow the total sound intensity to be controlled without having a significant effect on the volume of air produced by the fan.

Figure 21:
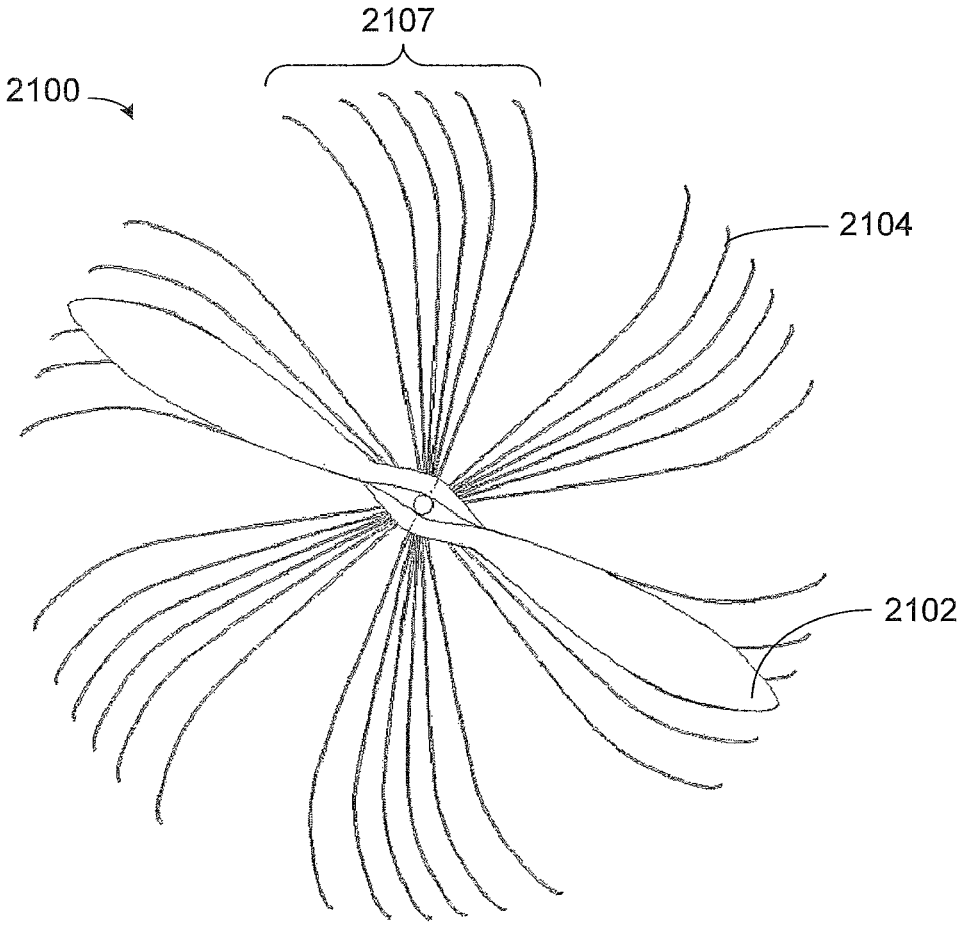
FIG. 21 is an axial view of another preferred embodiment of the invention with a petal assembly comprising six groups of six proximity vanes.
Figure 22:
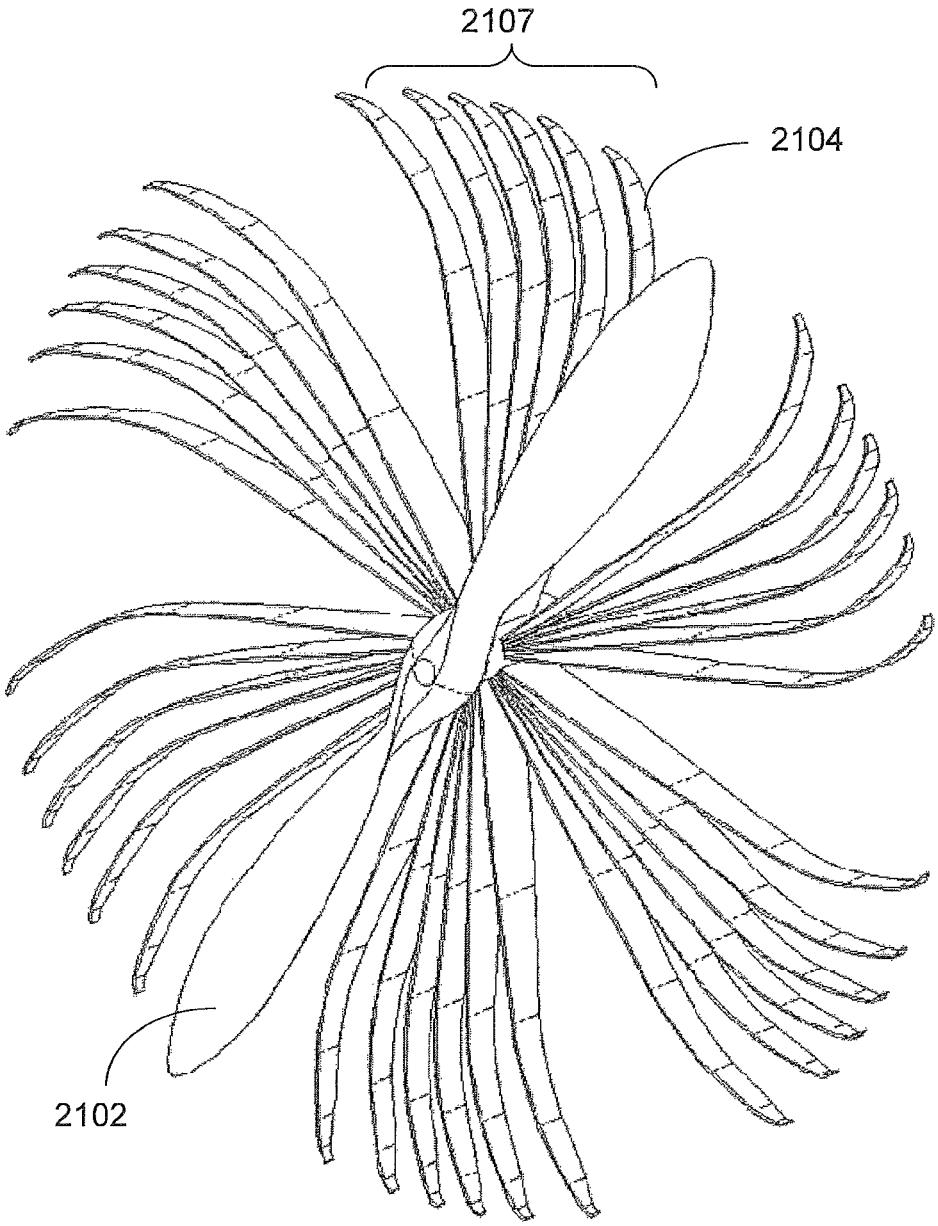
FIG. 22 is an oblique view of the embodiment shown in FIG. 21.

FIGS. 21 and 22 show another preferred embodiment of the present invention. Applicants have discovered that one method of creating a greater pressure wave (i.e., a louder fan volume) out of the interaction between petal assemblies (as shown above) and fan blades is to repeat this interaction more frequently. Thus, in the embodiment of FIGS. 21 and 22, the petal assembly 2107 comprises a much larger number of vanes 2104 than are used in the embodiments described above (also each vane is completely separate rather than being joined with another vane to form a petal as in FIG. 5 above). For example, FIG. 21 is an axial view of an embodiment of the invention 2100 having six groups of six vanes each (a total of 36 proximity vanes). FIG. 22 is an oblique view of the embodiment shown in FIG. 21, which shows the depth of the proximity vanes 2204 in this preferred embodiment. Each group of six vanes 2207 is grouped together, with a space in between each group. The groupings of the proximity vanes and the spacing density within groups is calculated and arranged so that pressure wave created as the fan blades 2102 pass over each grouping on proximity vanes roughly follows a sine wave, which has been shown in tests to produce a more soothing sound. Applicants have also discovered that this not only produces a pleasing sound quality, but also that the grouping of proximity vanes creates an additive effect in overall sound volume. Preferably, the distance between the fan blades and the proximity vanes can be adjusted to adjust sound volume as described above. Also, the proximity vanes in the embodiment shown in FIGS. 21 and 22 are mounted co-axially with the fan blades and rotate at a different speed than the fan blades, as also described above.

In the embodiment of FIGS. 21 and 22, the proximity vanes are shaped to follow the shape of the leading edge of the fan blades. This allows for the production of the maximum pressure wave (for a given distance between the blade and the vane) as the fan blade passes each proximity vane. Also, the grouping of the vanes produces a broader pressure pulse as the smaller individual pulses add together.

A problem with the embodiment of FIGS. 21 and 22 is that where the pressure wave results from this kind of matching of the shape of the vanes with the shape of the blade leading edge the sound produced by tends to be loud, but also more harsh. The pressure spike produces a characteristic sharp sound that is undesirable in some cases.

Figure 23:
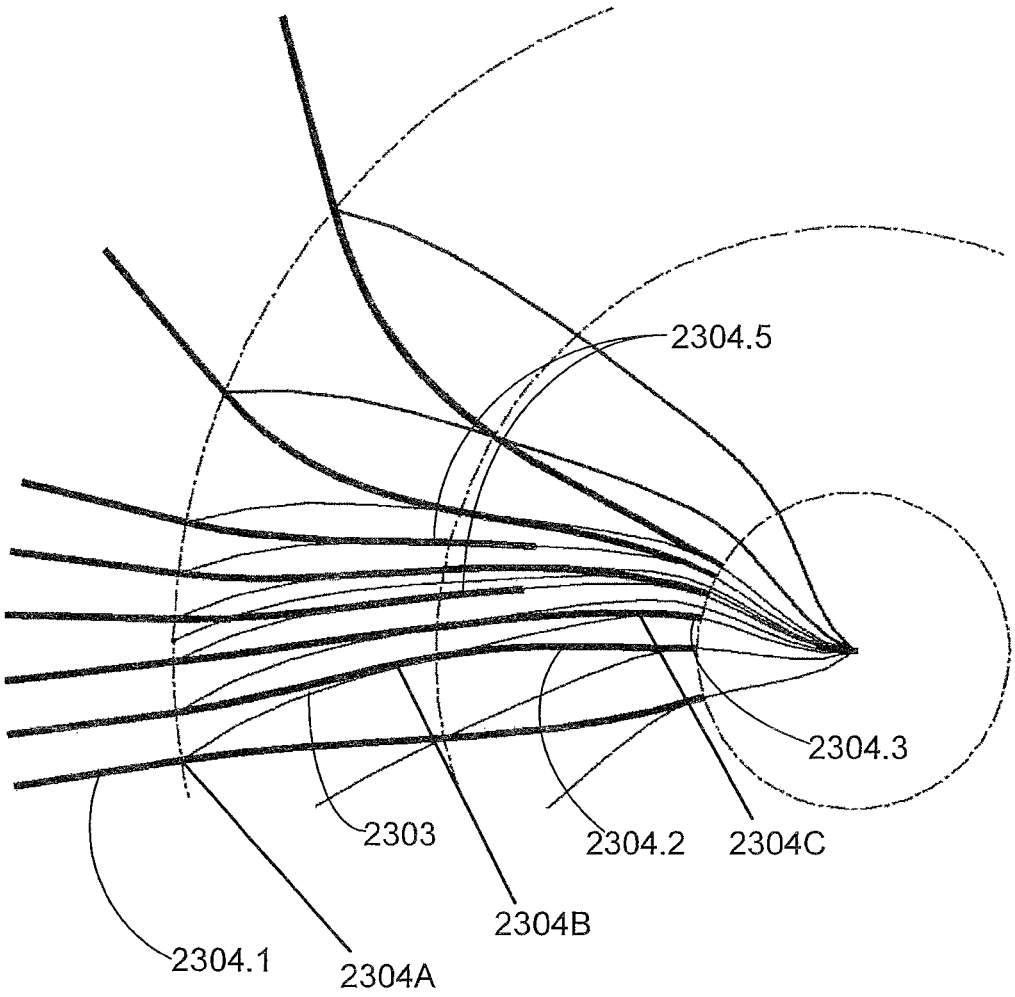
FIG. 23 is an axial view of an arrangement of proximity vanes according to another preferred embodiment of the invention.
Figure 24:
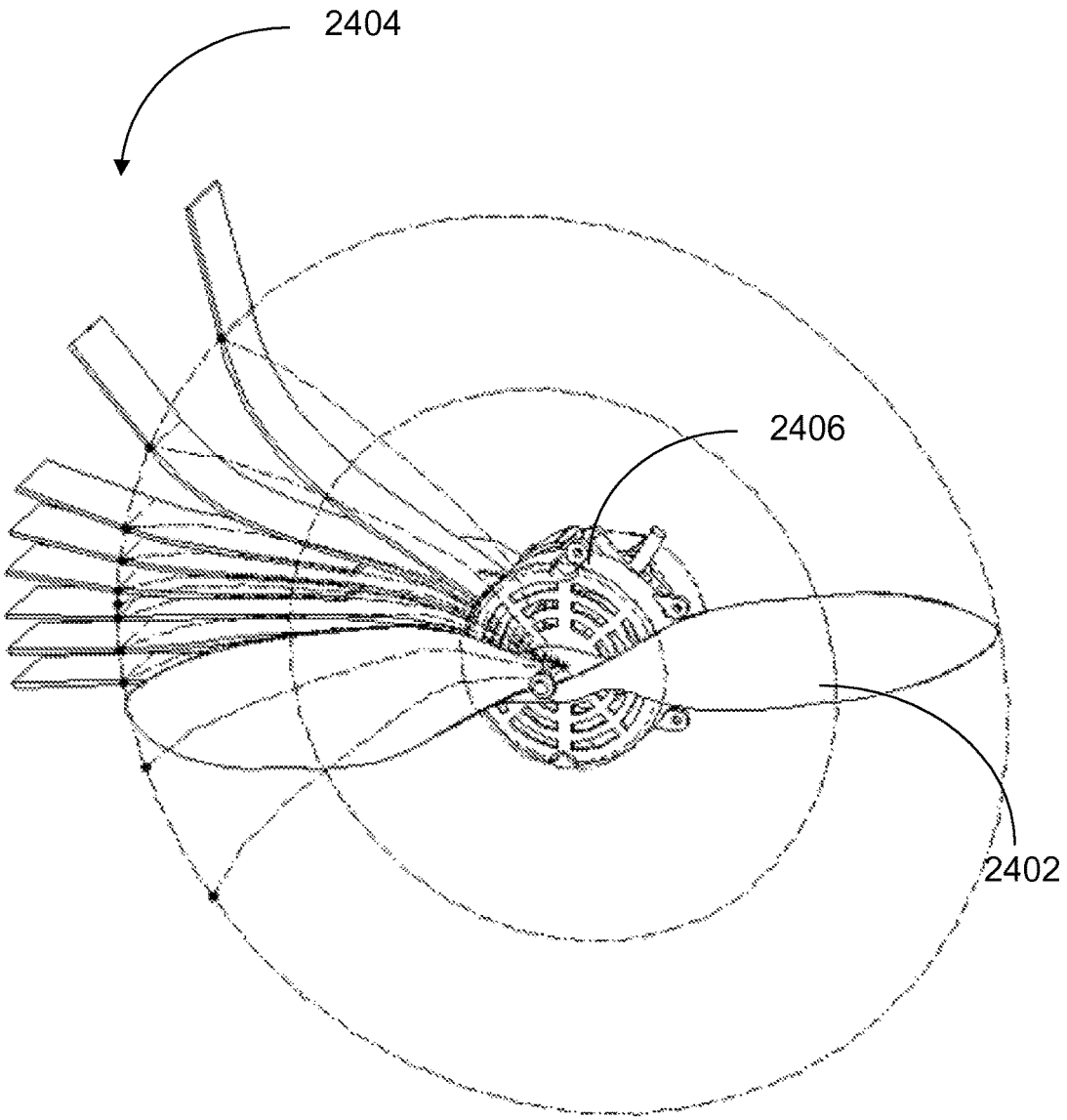
FIG. 24 is an oblique view of the embodiment of FIG. 26.
Figure 25:
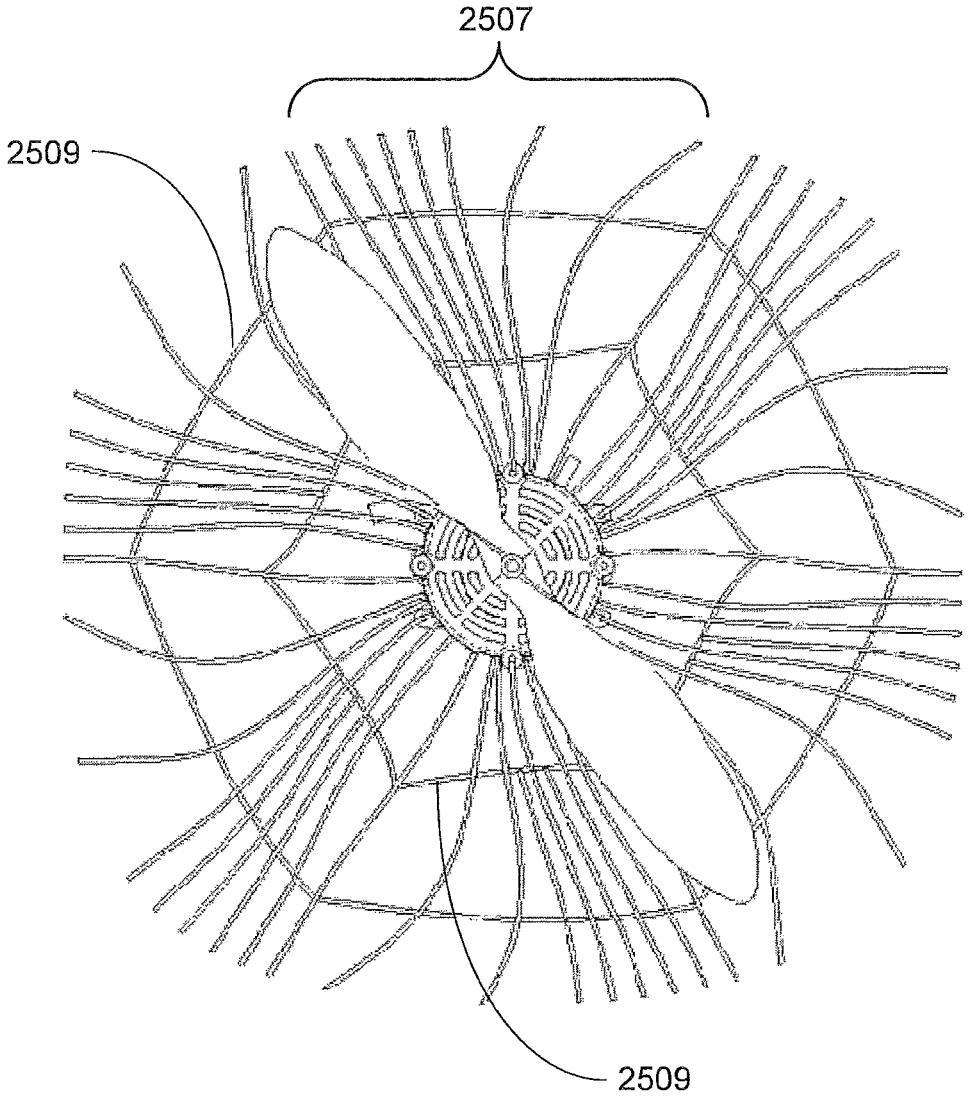
FIG. 25 is an axial view of an embodiment of the present invention using the vane-grouping pattern shown in FIG. 23.
Figure 26:
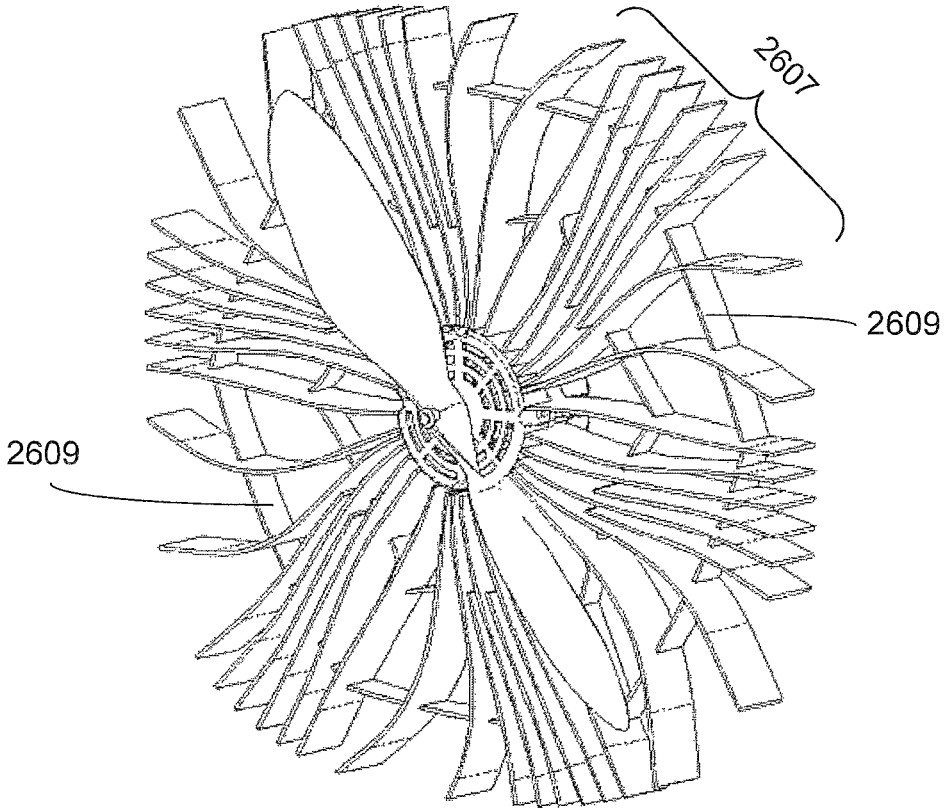
FIG. 26 is an oblique view of the embodiment shown in FIG. 25.

FIGS. 23 to 27 show another preferred embodiment of the present invention, which also makes use of a large number of proximity vanes but vanes are varied in shape and are spread out so that the leading edge position of a fan blade will be interacting with multiple vanes (in this case, three) at the maximum calculated spacing density. FIG. 23 is an axial view of one preferred grouping of eight vanes 2304.1-2304.8. FIG. 24 is an oblique view of the vanes 2404 of embodiment of FIG. 23, with motor 2406 and fan blade 2402 also shown. FIG. 25 is an axial view of an embodiment using the vane-grouping pattern 2507 shown in FIG. 23, while FIG. 26 is an oblique view of the embodiment using the vane-grouping pattern 2607 shown in FIG. 25.

Figure 27:
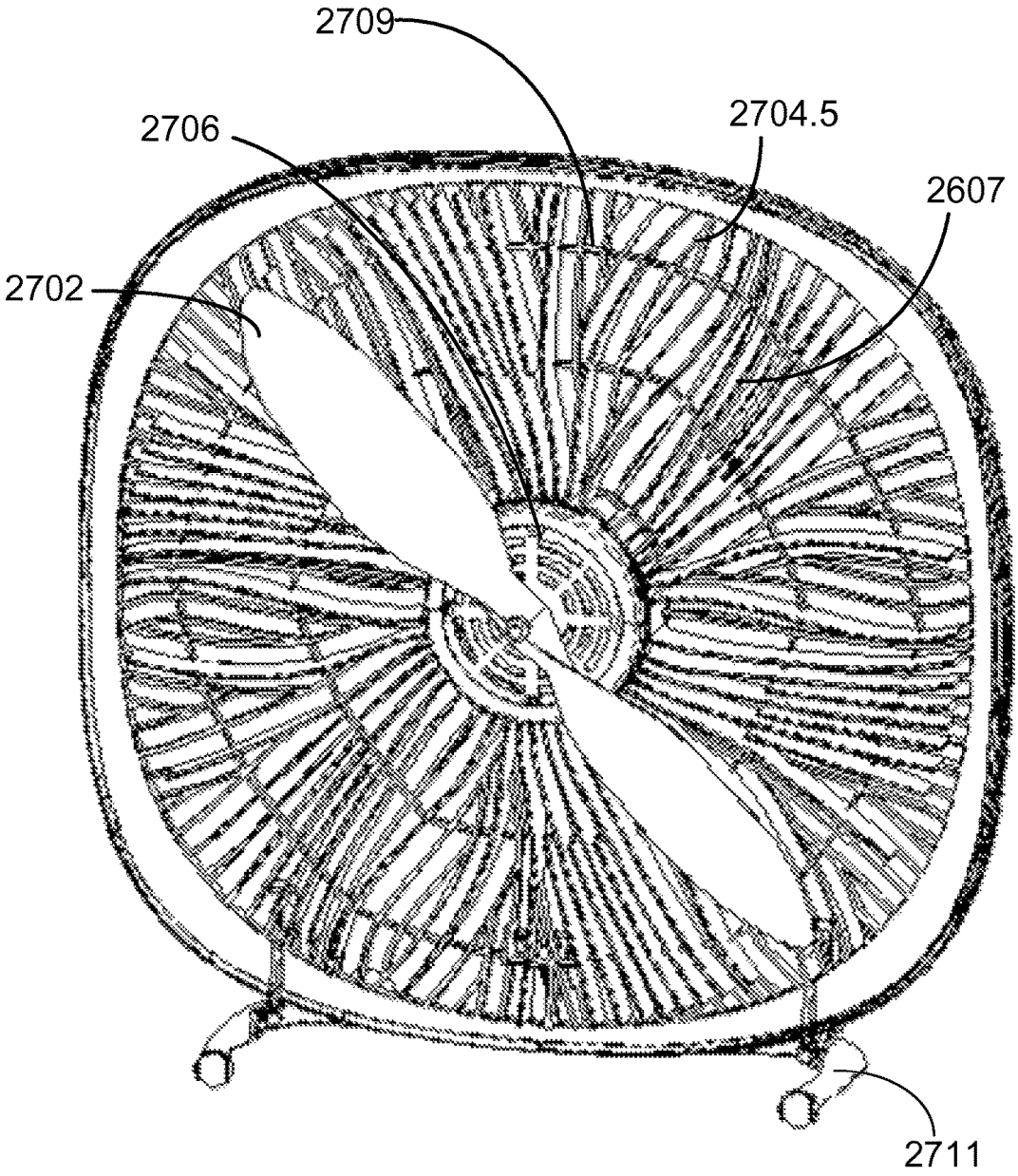
FIG. 27 is an oblique view of the embodiment shown in FIG. 25 where the vanes are integrated along with struts to form the back grill of a fan enclosure.

Finally, FIG. 27 is an oblique view of the embodiment shown in FIG. 25 where the vanes 2607 are integrated along with struts 2709 to form the back grill of the fan enclosure. FIG. 27 also shows fan blade 2702, motor 2706, and stand feet 2711.

The grouping pattern of FIG. 23 includes eight separate proximity vanes. Referring also to FIGS. 25 and 26, this pattern of eight vanes can be repeated six times round the axis of the fan blades. In FIG. 23, lines 2303 represent calculated-density positions of a leading edge of the fan blade as it passes the proximity vanes. At each position, the leading edge of the fan blade will actually be interacting with multiple vanes. For example, at the edge position shown by reference number 2303, the blade edge will be crossing vane 2304.1 at position 2304A, vane 2304.2 at position 2304B, and vane 2304.3 at position 2304C. As a result, the interaction is more gradual, and as a result the sound produced will not be as sharp as in the embodiment of FIGS. 21 and 22.

Also, the spacing density of the vanes as shown will still produce the same overall type of change in the pressure wave as described in the previous embodiment. As shown in FIG. 23, the spacing of the vanes is denser toward the center of the group and more spread out (less dense) at the beginning and end of the group. The leading edge of the fan blade will see more vanes per millisecond in the center of the groups than at the outer edges, which also allows the aggregate pressure wave to follow a general sine wave pattern, as in the previous embodiment. This results in a more satisfactory sound quality (a less harsh sound) while still providing for a greatly increased fan sound volume.

In the preferred embodiment of FIGS. 23 to 27, the vanes can be stationary and integrated into the back grill of the fan enclosure or as a coaxial, rotating vane assembly as described previously. In the embodiment of FIGS. 23 to 27, all of the vanes, for example vanes 2304.5 and 2704.5, do not necessarily extend to the central hub. As shown in FIGS. 25 through 27, bracing struts 2509, 2609 and 2709 can extend around the vane assembly forming a web-like shape.

FIGS. 28 to 32 show a ceiling fan assembly 2800 according to preferred embodiments of the present invention that is intended to be mounted on a ceiling facing downward. In the embodiment of FIGS. 28 to 32, the primary fan blades 2802 of which have controllable proximity interaction with a secondary set of fan blades 2804, which have an airfoil cross-section and are opposite in sense (screw direction) from the main blades 2802. These secondary blades 2804 may be driven by a motor 2806, allowed to rotate freely about the fan axis driven by the airflow in a direction opposite to the main blades 2802, slowed by a braking mechanism, or retained stationary. For a given proximity distance, a higher relative velocity caused, for example, by counter-rotation, will increase the magnitude of the pressure interaction.

Figure 28:
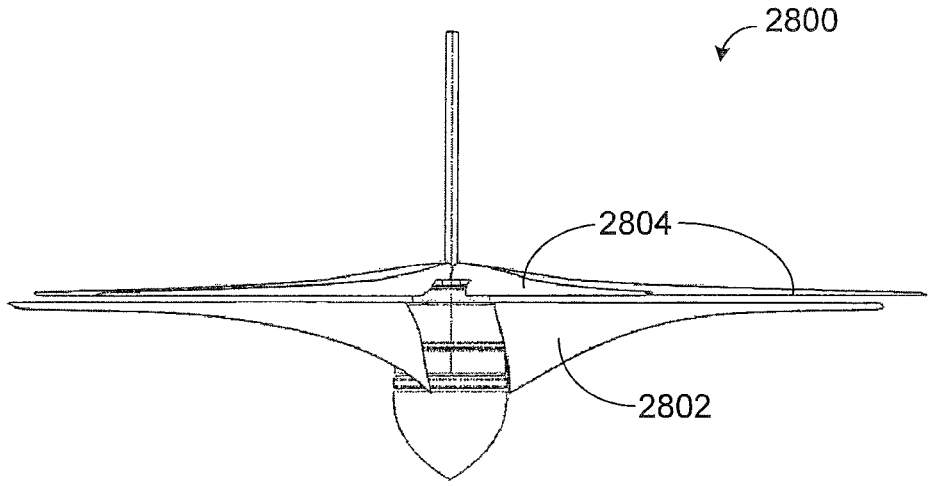
FIG. 28 shows a ceiling fan according to preferred embodiments of the present invention.
Figure 29:
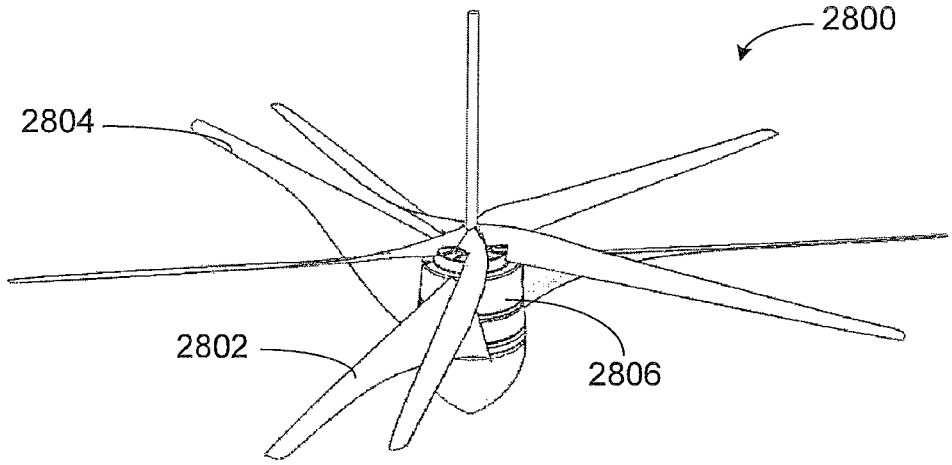
FIG. 29 is a perspective view from above of the embodiment shown in FIG. 28.
Figure 30:
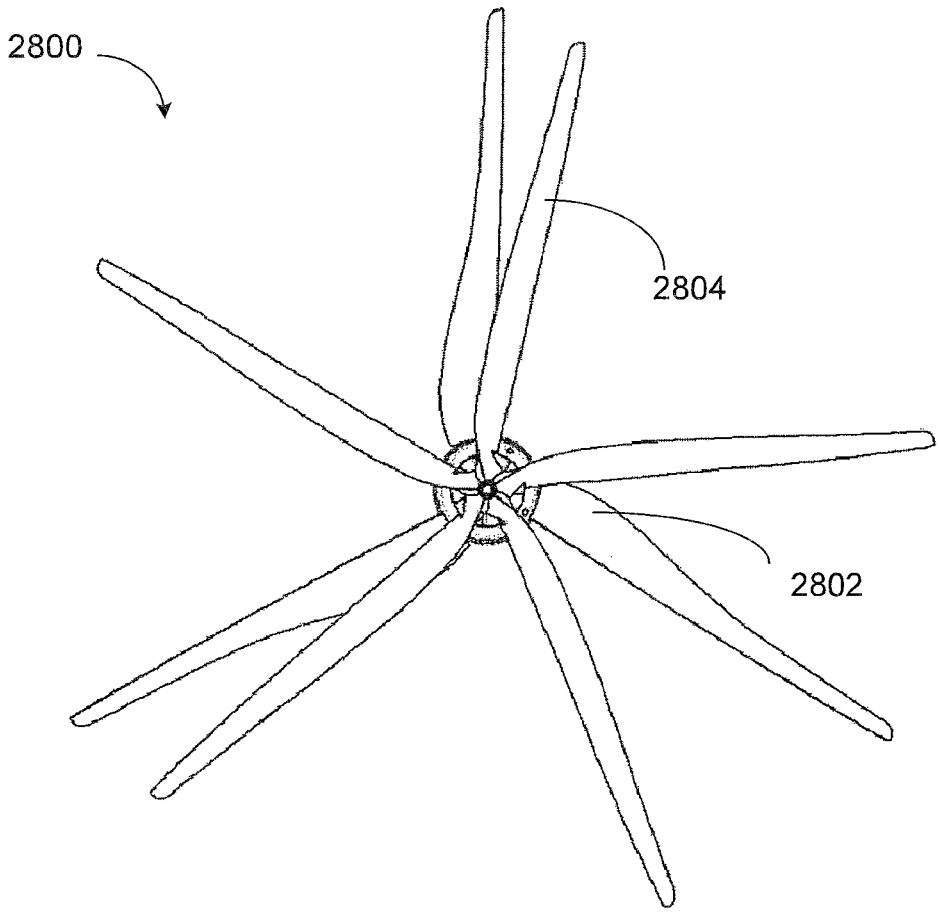
FIG. 30 is a downward-looking axial view of the embodiment shown in FIG. 28.
Figure 31:
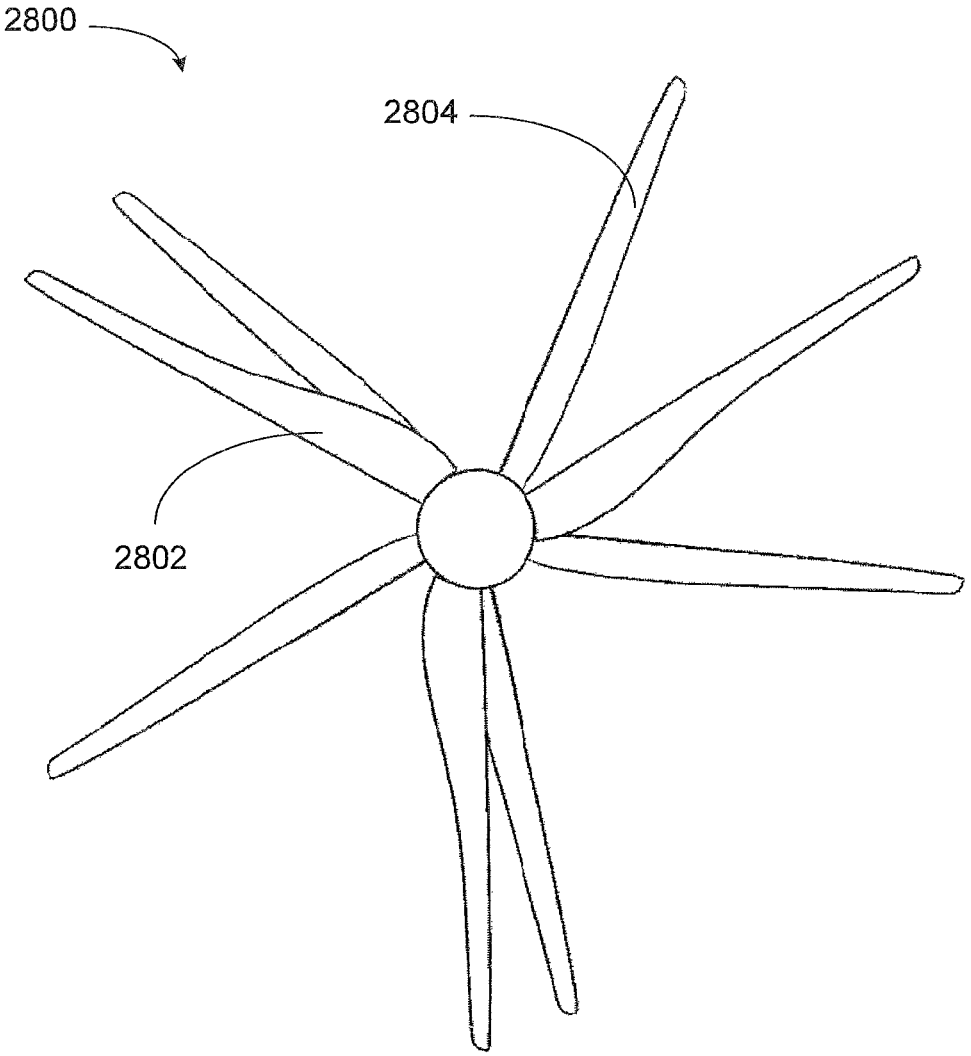
FIG. 31 is an upward-looking axial view of the embodiment shown in FIG. 28.
Figure 32:
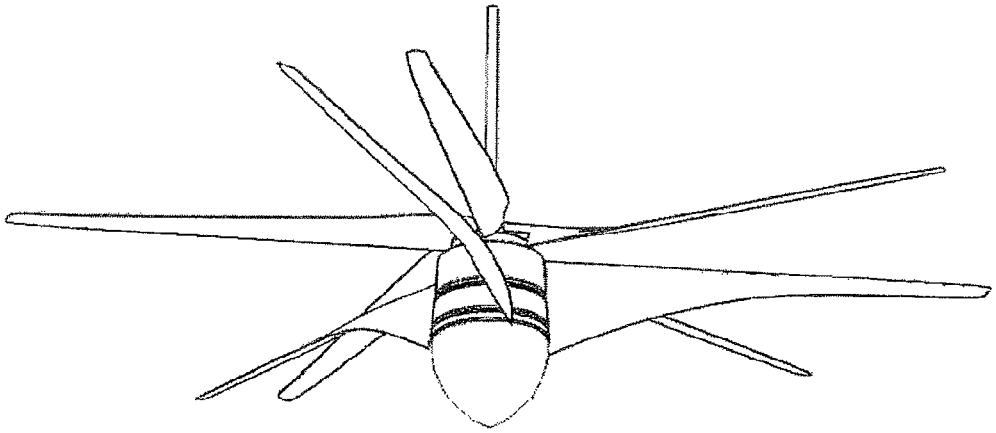
FIG. 32 is a perspective view from below of the embodiment shown in FIG. 28.
Figure 33A:
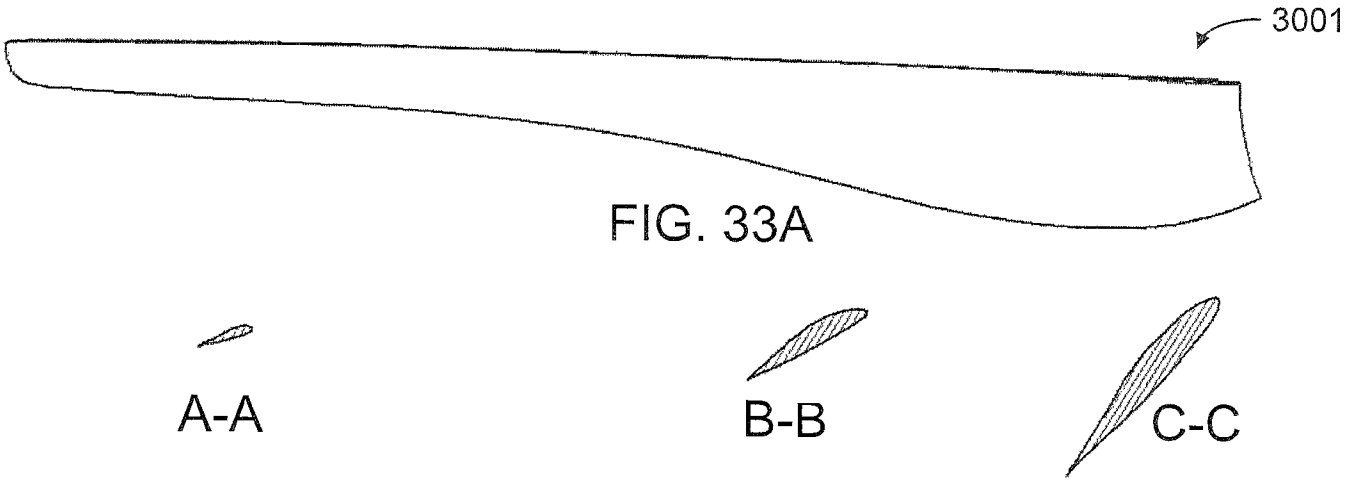
FIGS. 33A and 33B show orthogonal views of a typical fan blade of the embodiment shown in FIG. 28.
Figure 33B:
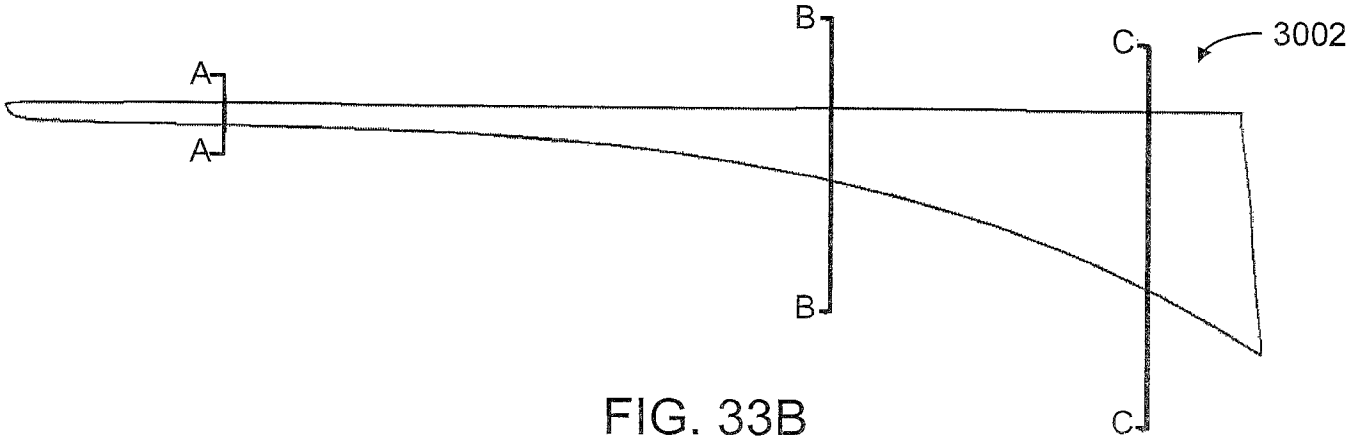

FIGS. 33A and 33B show orthogonal views of a typical blade for use with the embodiment shown in FIG. 28, with an bottom view 3001 (the view that would be seen along the ceiling fan rotational axis looking from the bottom of the mounted fan), a lateral view 3002, and cross-sectional profile views of the blade near its tip along line A-A, at the midsection along line B-B, and near the blade root along line C-C.

Although the description of the present invention above is mainly directed at an apparatus (i.e., sleep fans), it should be recognized that methods of producing such an apparatus would further be within the scope of the present invention. Further, although much of the previous description is directed at fans producing a pleasing background noise for use while sleeping, the invention could be applied to other suitable uses where a similar background noise is desired. Also, embodiments of the present invention could be used to produce noise other than red noise or pseudo red noise if desired. Preferred embodiments of the present invention could comprise any known type of power-operated fan, including but not limited to portable fans, floor-standing fans, pedestal fans, table fans, box fans, window fans, exhaust fans, or ceiling fans.

In the discussion herein and in the claims, the terms "including" and "comprising" are used in an open-ended fashion, and thus should be interpreted to mean "including, but not limited to . . . ." Further, whenever the terms "automatic," "automated," or similar terms are used herein, those terms will be understood to include manual initiation of the automatic or automated process or step. To the extent that any term is not specially defined in this specification, the intent is that the term is to be given its plain and ordinary meaning. The accompanying drawings are intended to aid in understanding the present invention and, unless otherwise indicated, are not drawn to scale.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A powered fan assembly comprising:

a fan blade for producing airflow when rotated;

a motor for rotating the fan blade;

a moveable proximity element positioned within the airflow field produced when the fan blade is rotated so that noise is generated as the fan blade is rotated past the proximity element and the overall volume of the fan assembly is increased, wherein the position of the proximity element relative to the blade can be adjusted to vary the volume of noise produced during rotation of the fan blade and in which the proximity element is rotated around the fan blade rotational axis during operation of the fan assembly; and in which adjusting the position of the proximity element relative to the blade causes the volume of noise produced when the fan assembly is operated to vary without varying the airflow produced by the fan assembly by more than 10%.

2. A powered fan assembly comprising:

a fan blade for producing airflow when rotated;

a motor for rotating the fan blade;

a moveable proximity element positioned entirely inside the airflow field produced when the fan blade is rotated so that noise is generated as the fan blade is rotated past the proximity element, wherein the proximity element comprises a plurality of proximity elements arranged coaxially around the fan blade rotational axis, the plurality of proximity elements are rotated around the fan blade rotational axis, and the position of the proximity element relative to the blade can be adjusted to vary the volume of noise produced during rotation of the fan blade; and in which adjusting the position of the proximity element relative to the blade causes the volume of noise produced when the fan assembly is operated to vary without varying the airflow produced by the fan assembly by more than 10%.

3. The fan assembly of claim 2 in which adjusting the position of the proximity element relative to the blade comprises adjusting the spacing between the proximity element and the fan blade.

4. The fan assembly of claim 2 in which the plurality of proximity elements are rotated around the fan blade rotational axis at a rotational speed that is different than the rotational speed of the fan blade.

5. The fan assembly of claim 2 in which the proximity element is located upstream from the fan blade so that the primary direction of airflow is away from the proximity element.

6. The fan assembly of claim 2 in which the interaction of the pressure wave produced by the rotating fan blades with the proximity element causes the creation of a modified pressure wave resulting in the generation of noise in addition to the noise produce by the rotation of the fan blades alone.

7. The fan assembly of claim 6 in which the modified pressure wave follows a sinusoidal curve.

8. The fan assembly of claim 2 in which the noise produced by the interaction of the airflow produced by the fan blades and the proximity element produces predominately pseudo-red noise.

9. The fan assembly of claim 2 in which the fan assembly comprises a pedestal fan.

10. The fan assembly of claim 2 in which the proximity element is non-motorized.

11. A powered fan assembly comprising:

a rotating fan blade for producing airflow during operation of the fan assembly;

a motor for rotating the fan blade;

a proximity element moveably positioned within the airflow field produced when the fan blade is rotated so that the proximity element interacts with the pressure wave produced by the rotating fan blade to increase the overall sound volume produced during operation of the fan assembly wherein the position of the proximity element relative to the blade can be adjusted to vary the volume of sound produced during rotation of the fan blade by moving the proximity element closer to the fan blade to increase the overall volume of sound produced or moving the proximity element further away from the fan blade to reduce the overall volume of sound produced;

in which adjusting the position of the proximity element relative to the blade causes the overall sound volume when the fan assembly is operated to vary without varying the airflow produced by the fan assembly by more than 10%; and in which the proximity element is rotated around the fan blade rotational axis during operation of the fan assembly.

* * * * *